US012104456B2

(12) United States Patent
Scruggs et al.

(10) Patent No.: US 12,104,456 B2
(45) Date of Patent: Oct. 1, 2024

(54) TIME-DELAYED, DOWNHOLE TRIGGER

(71) Applicant: SPARTAN DOWNHOLE, INC, Houston, TX (US)

(72) Inventors: Justin Scruggs, Houston, TX (US); Jeffrey Johnston, Houston, TX (US)

(73) Assignee: SPARTAN TECHNOLOGY DEVELOPMENT CORPORATION, Houston, TX (US)

( * ) Notice: Subject to any disclaimer, the term of this patent is extended or adjusted under 35 U.S.C. 154(b) by 226 days.

(21) Appl. No.: 17/720,260

(22) Filed: Apr. 13, 2022

(65) Prior Publication Data

US 2022/0333459 A1 Oct. 20, 2022

Related U.S. Application Data

(60) Provisional application No. 63/174,952, filed on Apr. 14, 2021.

(51) Int. Cl.
*E21B 34/06* (2006.01)
*E21B 34/14* (2006.01)

(52) U.S. Cl.
CPC ..... *E21B 34/066* (2013.01); *E21B 34/14* (2013.01)

(58) Field of Classification Search
CPC ..... E21B 34/066; E21B 34/14
See application file for complete search history.

(56) References Cited

U.S. PATENT DOCUMENTS 2,573,110 A * 10/1951 Robison ..... E21B 43/123 137/155
4,410,038 A * 10/1983 Drapp ..... E21B 43/1235 417/57
6,021,095 A * 2/2000 Tubel ..... E21B 47/20 166/166
2005/0039527 A1* 2/2005 Dhruva ..... E21B 49/10 73/152.27

FOREIGN PATENT DOCUMENTS

EP 551163 A1 * 7/1993 ..... E21B 34/066

* cited by examiner

*Primary Examiner* — Dany E Akakpo
(74) *Attorney, Agent, or Firm* — CLEARPAT SERVICES, LLC

(57) ABSTRACT

A downhole actuator device is provided for use in directing wellbore fluid to be used in performing work in a wellbore by convening a pressure source into a force exerted over a distance. The core components of the downhole actuator device include a pressure chamber containing an insertable activation module, an insertable pressure source module capable of generating a pressure or force and a pressure responsive member. The core components of the pressure source module can include one or more of a plurality of optional formats for delivery of the force comprising a solenoid and a mechanical trigger, a non-explosive pyrotechnic device insert, or a charged gas module insert, which, when appropriately combined, sequenced and activated, will open a pressure responsive member that will allow wellbore fluid, at hydrostatic pressure, to enter the tool thereby providing the energy needed to actuate various mechanical and/or hydraulic components downhole. Multiple variations of the device are provided to allow for either pressure activated or surface activated variations of the device. Additional variable components may include a timer circuit, a (Continued)

power module, a proximal pressure actuated piston, various sub connections, a wireline or slickline cable.

21 Claims, 16 Drawing Sheets

TIME-DELAYED, DOWNHOLE TRIGGER

CROSS-REFERENCE

This application claims the benefit of U.S. Provisional Application No. 63/174,952, filed Apr. 14, 2021, which application is incorporated herein by reference.

BACKGROUND OF THE INVENTION

Without limiting the scope of the present invention, its background will be described in relation to hydraulic plug setting tool assemblies, as an example.

This invention relates in general to a wellbore tool utilized for directing wellbore fluid to be used in performing work in a wellbore by converting a force or pressure source into a force exerted over a distance.

The invention is related to an initiating mechanism for downhole tools used in the oil industry. The initiating mechanism or trigger replaces the function of a motor or other mechanism that retracts a valve pin and allows hydrostatic fluid to enter the tool. The initiator or trigger generates a force, a pressure or an action that generates the force that moves a pilot valve and allows hydrostatic fluid to enter the tool body and load the setting piston (or other tools) down below in the wellbore.

SUMMARY OF THE INVENTION

The present disclosure details a system for a different, more dependable, more precise and cost-effective triggering and actuation mechanism. The disclosed apparatus does not use specific pressures or other well parameters to trigger a setting device, but rather uses a combination of pressure and independent time-delayed actuation to trigger the function of the tool.

Provided herein is a downhole actuator device for use in directing wellbore fluid to be used in performing work in a wellbore, said downhole actuator device comprising: a pressure chamber; an insertable activation module; a mechanical trigger capable of releasing a force or pressure within the pressure chamber when activated by the insertable activation module; and a pressure responsive member which is selectively moveable from a closed position to an open position by said activation module and mechanical trigger; wherein, when said pressure responsive member moves from a closed position to an open position, wellbore fluid is allowed to enter the device thru an exposed passage in the pressure chamber distal to said pressure responsive member.

In some embodiments, the insertable activation module comprises: an electro-mechanical activation mechanism; a custom logic circuit board; an integrated timer module on said circuit board; and an activation circuit to carry energy from the circuit board to the electro-mechanical activation mechanism.

In some embodiments, the mechanical trigger comprises: a plurality of retainer dogs; a trigger sleeve; a trigger sleeve spring; a sear arm housing; and a plurality of sear arms; wherein the plurality of retainer dogs are configured to drop away in order to unconstraint the trigger sleeve when the electro-mechanical activation mechanism activates; thus when the trigger sleeve moves toward the electro-mechanical activation mechanism due to the sleeve spring, thus releasing the constrained sear arms, the sear arms collapse within the sear arm housing and allow the pressure responsive member to move from a closed position to an open position.

In some embodiments, the retainer dogs are spherical balls.

In some embodiments, the pressure responsive member comprises a spring-loaded pilot valve.

In some embodiments, the spring-loaded pilot valve is not pressure balanced and therefore the wellbore fluid is also trying to move the pilot valve.

In some embodiments, the downhole actuator device is configurable to be adapted with an insertable power module; and an insertable pressure actuation member, within the pressure chamber, for pressure activation of the insertable activation module.

In some embodiments, the downhole actuator device is configurable to adapt to a wireline or e-line; an e-coil tubing; or a digital slickline for surface activation of the insertable activation module.

In some embodiments, the downhole actuator device is configurable to adapt to a cable head, a crossover sub, a top sub, a bottom sub; or a crossover sub, a top sub and a bottom sub; or any combination thereof.

In some embodiments of the downhole actuator device, the electro-mechanical activation mechanism comprises a solenoid.

In some embodiments of the downhole actuator device, the timer module comprises: a time keeping circuit using a microprocessor, microcontroller or other digital processor; or a counting circuit without a microprocessor, microcontroller or other processor, such as an oscillator or counter; or a time keeping circuit using an RC (resistor-capacitor) oscillator circuit.

In some embodiments of the downhole actuator device, an activation circuit within the insertable activation module comprises: an electrical conductor mechanism comprising a positive and negative terminal connection on a first end and a positive and negative terminal connection on a second end; and

- a switch to connect the energy in the insertable power module to the electro-mechanical actuation mechanism; or
- a switch to connect the energy in the insertable power module to a power conversion circuit to step up the voltage to the electro-mechanical actuation mechanism; or
- a switch to connect the energy in the insertable power module to a power conversion circuit to step down the voltage to the electro-mechanical actuation mechanism; or
- transistor to connect the energy in the insertable power module to the electro-mechanical actuation mechanism; or
- a transistor to connect the energy in the insertable power module to a power conversion circuit to step up the voltage to the electro-mechanical actuation mechanism; or
- a transistor to connect the energy in the insertable power module to a power conversion circuit to step down the voltage to the electro-mechanical actuation mechanism; or
- relay to connect the energy in the insertable power module to the electro-mechanical actuation mechanism; or
- a relay to connect the energy in the insertable power module to a power conversion circuit to step up the voltage to the electro-mechanical actuation mechanism; or a relay to connect the energy in the insertable power module to a power conversion circuit to step down the voltage to the electro-mechanical actuation mechanism; or direct conductors between the positive terminals on the first end and the second end and the negative terminals on the first end and the second end.

In some embodiments of the downhole actuator device, the insertable power module comprises at least one battery.

In some embodiments of the downhole actuator device, the insertable power module comprises a plurality of batteries.

In some embodiments of the downhole actuator device, the at least one battery configuration of the insertable power module comprises a 1.5V battery, a 3V battery, a 3.7V battery, a 3.9V battery, a 4.5V battery, a 9V battery, an E battery, a PP3 battery, a 6LR61 battery, a 6F22 battery, a 1604A battery, a 1604D battery, a MN1604 battery, an A battery, a AA battery, a AAA battery, a B battery, a C battery, a D battery, a DD battery, an F battery, (commonly found in 6V rectangular lantern batteries), an aluminum-air battery, a lithium-ion battery, a lithium polymer battery, an alkaline battery, a lead-acid battery, a nickel battery, a nickel-cadmium battery, a nickel-metal hydride battery, or a solid-state composition battery.

In some embodiments of the downhole actuator device, the configuration of the insertable power module with a plurality of batteries comprises a plurality of 1.5V batteries, a plurality of 3V batteries, a plurality of 3.7V batteries, a plurality of 3.9V batteries, a plurality of 4.5V batteries, a plurality of 9V batteries, a plurality of E batteries, a plurality of PP3 batteries, a plurality of 6LR61 batteries, a plurality of 6F22 batteries, a plurality of 1604A batteries, a plurality of 1604D batteries, a plurality of MN1604 batteries, a plurality of A batteries, a plurality of AA batteries, a plurality of AAA batteries, a plurality of B batteries, a plurality of C batteries, a plurality of D batteries, a plurality of DD batteries, a plurality of F batteries, (commonly found in 6V rectangular lantern batteries), a plurality of aluminum-air batteries, a plurality of lithium-ion batteries, a plurality of lithium polymer batteries, a plurality of alkaline batteries, a plurality of lead-acid batteries, a plurality of nickel batteries, a plurality of nickel-cadmium batteries, a plurality of nickel-metal hydride batteries, or a plurality of solid-state composition batteries.

In some embodiments of the downhole actuator device, the insertable power module comprises a plurality of batteries arranged in series circuitry.

In some embodiments of the downhole actuator device, the insertable power module comprises a plurality of batteries arranged in parallel circuitry.

In some embodiments of the downhole actuator device, the insertable power module comprises a plurality of batteries arranged in series-parallel circuitry.

In some embodiments of the downhole actuator device, the insertable pressure actuation member comprises a pressure activated piston.

In some embodiments of the downhole actuator device, the pressure actuated piston comprises a variable number of shear pins pre-configurable to release the pressure actuated piston at selectable pressures.

In any one of the embodiments, the downhole actuator device, is configurable to adapt to any one of or a plurality of conveyance mechanisms for downhole delivery and/or retrieval comprising: a slickline cable, a wireline cable, a coiled tubing, a drill pipe, a well tractor, a casing, and/or a tubing.

Provided herein is a downhole actuator device for use in directing wellbore fluid to be used in performing work in a wellbore, said downhole actuator device comprising: a pressure chamber, an insertable activation module comprising: a solenoid, a custom logic circuit board, an integrated timer module on the circuit board, and an activation circuit to carry energy from the circuit board to the solenoid; a mechanical trigger capable of releasing a force or pressure within the pressure chamber when activated by the activation circuit; and a pressure responsive member which is selectively moveable from a closed position to an open position by the activation module and mechanical trigger; wherein the mechanical trigger comprises a plurality of retainer dogs configured to drop away and to unconstrain a trigger sleeve when activated by the solenoid, the trigger sleeve moves toward the solenoid due to an associated sleeve spring, releasing a plurality of sear arms, the sear arms collapse within an associated sear arm housing and allow the pressure responsive member to move from a closed position to an open position; and wherein, when the pressure responsive member moves from a closed position to an open position, wellbore fluid is allowed to enter the device thru an exposed passage in the pressure chamber distal to the pressure responsive member.

In some embodiments of the downhole actuator device, the device is configurable to be surface activated using externally attached components comprising: a wireline or e-line, an e-coil tubing or a digital slickline.

In some embodiments of the downhole actuator device, the device is configurable to be pressure activated using additional internal components within the pressure chamber further comprising: an insertable power module and an insertable pressure actuation member; wherein the insertable power module comprises: at least one battery; or a plurality of batteries arranged in series circuitry, in parallel circuitry or in series-parallel circuitry; and wherein the insertable pressure actuation member comprises a pressure activated piston.

In some embodiments of the downhole actuator device, the pressure activated piston comprises a variable number of shear pins configured to release the pressure actuated piston at operator-selectable pressures.

In some embodiments of the downhole actuator device, the device is configurable for attachment to a crossover sub, a top sub, or a bottom sub; or a crossover sub, a top sub and a bottom sub; or any combination thereof.

In some embodiments of the downhole actuator device, the device is further configurable to adapt to any one of or a plurality of conveyance mechanisms for downhole delivery and/or retrieval comprising: a slickline cable, a wireline cable, a coiled tubing, a drill pipe, a well tractor, a casing or a tubing.

Provided herein is a downhole actuator device for use in directing wellbore fluid to be used in performing work in a wellbore, said downhole actuator device comprising: a pressure chamber, insertable activation module comprising: a solenoid, a custom logic circuit board, an integrated timer module on the circuit board, and an activation circuit to carry energy from the circuit board to the solenoid; and a mechanical trigger capable of releasing a force or pressure within the pressure chamber when activated by the activation circuit; and a pressure responsive member which is selectively moveable from a closed position to an open position by the activation module and mechanical trigger; wherein the mechanical trigger comprises a plurality of retainer dogs (or balls) configured to drop away and to unconstrain a trigger sleeve when activated by the solenoid, the trigger sleeve moves toward the solenoid due to an associated sleeve spring, releasing a plurality of sear arms, the sear arms collapse within their associated sear arm housing and allow the pressure responsive member to move from a closed position to an open position; wherein, when the pressure responsive member moves from a closed position to an open position, wellbore fluid is allowed to enter the device thru an exposed passage in the pressure chamber distal to the pressure responsive member; and wherein the downhole actuator is configurable for either surface activation through an electrical signal sent down from the surface via wireline or comparable mechanism, or for downhole pressure activation with the addition of further pressure chamber insertable internal features comprising an insertable power module and an insertable pressure actuation member.

Provided herein is a downhole actuator device for use in directing wellbore fluid to be used in performing work in a wellbore, said downhole actuator device comprising: a pressure chamber, an insertable activation module capable of generating a force or pressure within the pressure chamber when activated and a pressure responsive member which is selectively moveable from a closed position to an open position by the force or pressure generated by the activation module; wherein, when the pressure responsive member moves from the closed position to an open position, wellbore fluid is allowed to enter the device thru an exposed passage in the pressure chamber distal to the pressure responsive member.

In some embodiments of the downhole actuator device, the insertable activation module comprises: an insertable energy source, a custom logic circuit board, an integrated timer module on the circuit board, an activation circuit to carry energy from the circuit board to the insertable energy source and a non-pyrotechnic ignitor.

In some embodiments of the downhole actuator device, the insertable energy source container comprises: a non-explosive pyrotechnic; wherein the insertable energy source is capable of generating a force or pressure within the pressure chamber when activated by the activation circuit within the activation module, wherein the force or pressure passes through the pressure responsive member to move the pressure responsive member from the closed position to an open position; and wherein pressurized wellbore fluid is allowed to enter the tool thru the exposed passage in the pressure chamber, replacing the pressure generated by the insertable energy source and ensuring that the pressure responsive member remains in the open position due to an imbalance of forces on the pressure responsive member in a distal part of the pressure chamber below the pressure responsive member.

In some embodiments of the downhole actuator device, the pressure responsive member comprises a spring-loaded pilot valve.

In some embodiments, the spring-loaded pilot valve is not pressure balanced and therefore the pilot valve spring is provided to push the valve open at low pressures. In other embodiments, the pilot valve spring functions to keep pilot valve closed, resisting the pressure of the downhole wellbore fluid.

In some embodiments of the downhole actuator device, the device is configurable to be adapted with an insertable power module and an insertable pressure actuation member within the pressure chamber, for pressure activation of the insertable activation module.

In some embodiments of the downhole actuator device, the device is configurable to adapt to a wireline or e-line, or an e-coil tubing, or a digital slickline for surface activation of the insertable activation module.

In some embodiments of the downhole actuator device, the device is configurable to adapt to a crossover sub, or a top sub, or a bottom sub; or a crossover sub, a top sub and a bottom sub; or any combination thereof.

In some embodiments of the downhole actuator device, the timer module comprises: a time keeping circuit using a microprocessor, microcontroller or other digital processor; or a counting circuit without a microprocessor, microcontroller or other processor, such as an oscillator or counter; or a time keeping circuit using an RC oscillator circuit.

In some embodiments of the downhole actuator device, an activation circuit within the insertable activation module comprises: an electrical conductor mechanism comprising a positive and negative terminal connection on a first end and a positive and negative terminal connection on a second end and a switch to connect the energy in the insertable power module to the ignitor; or a switch to connect the energy in the insertable power module to a power conversion circuit to step up the voltage to the ignitor; or a switch to connect the energy in the insertable power module to a power conversion circuit to step down the voltage to the ignitor; or transistor to connect the energy in the insertable power module to the ignitor; or a transistor to connect the energy in the insertable power module to a power conversion circuit to step up the voltage to the ignitor; or a transistor to connect the energy in the insertable power module to a power conversion circuit to step down the voltage to the ignitor; or relay to connect the energy in the insertable power module to the ignitor; or a relay to connect the energy in the insertable power module to a power conversion circuit to step up the voltage to the ignitor; or a relay to connect the energy in the insertable power module to a power conversion circuit to step down the voltage to the ignitor; or direct conductors between the positive terminals on the first end and the second end and the negative terminals on the first end and the second end.

In some embodiments of the downhole actuator device, the insertable power module comprises at least one battery.

In some embodiments of the downhole actuator device, the insertable power module comprises a plurality of batteries.

In some embodiments of the downhole actuator device, the at least one battery configuration of the insertable power module comprises a 1.5V battery, a 3V battery, a 3.7V battery, a 3.9V battery, a 4.5V battery, a 9V battery, an E battery, a PP3 battery, a 6LR61 battery, a 6F22 battery, a 1604A battery, a 1604D battery, a MN1604 battery, an A battery, a AA battery, a AAA battery, a B battery, a C battery, a D battery, a DD battery, an F battery, (commonly found in 6V rectangular lantern batteries), an aluminum-air battery, a lithium-ion battery, a lithium polymer battery, an alkaline battery, a lead-acid battery, a nickel battery, a nickel-cadmium battery, a nickel-metal hydride battery, or a solid-state composition battery.

In some embodiments of the downhole actuator device, the configuration of the insertable power module with a plurality of batteries comprises a plurality of 1.5V batteries, a plurality of 3V batteries, a plurality of 3.7V batteries, a plurality of 3.9V batteries, a plurality of 4.5V batteries, a plurality of 9V batteries, a plurality of E batteries, a plurality of PP3 batteries, a plurality of 6LR61 batteries, a plurality of 6F22 batteries, a plurality of 1604A batteries, a plurality of 1604D batteries, a plurality of MN1604 batteries, a plurality of A batteries, a plurality of AA batteries, a plurality of AAA batteries, a plurality of B batteries, a plurality of C batteries, a plurality of D batteries, a plurality of DD batteries, a plurality of F batteries, (commonly found in 6V rectangular lantern batteries), a plurality of aluminum-air batteries, a plurality of lithium-ion batteries, a plurality of lithium polymer batteries, a plurality of alkaline batteries, a plurality of lead-acid batteries, a plurality of nickel batteries, a plurality of nickel-cadmium batteries, a plurality of nickel-metal hydride batteries, or a plurality of solid-state composition batteries.

In some embodiments of the downhole actuator device, the insertable power module comprises a plurality of batteries arranged in series circuitry.

In some embodiments of the downhole actuator device, the insertable power module comprises a plurality of batteries arranged in parallel circuitry.

In some embodiments of the downhole actuator device, the insertable power module comprises a plurality of batteries arranged in series-parallel circuitry.

In some embodiments of the downhole actuator device, the insertable pressure actuation member comprises a pressure activated piston.

In some embodiments of the downhole actuator device, the pressure actuated piston comprises a variable number of shear pins configured to release the pressure actuated piston at operator-selectable pressures.

In any one of the embodiments, the downhole actuator device, is configurable to adapt to any one of or a plurality of conveyance mechanisms for downhole delivery and/or retrieval comprising: a slickline cable, a wireline cable, a coiled tubing, a drill pipe, a well tractor, a casing, or a tubing.

Provided herein is a downhole actuator device for use in directing wellbore fluid to be used in performing work in a wellbore, said downhole actuator device comprising: a pressure chamber, insertable activation module comprising: an insertable energy source comprising: a non-explosive pyrotechnic; a custom logic circuit board, an integrated timer module on the circuit board, a non-pyrotechnic ignitor, and an activation circuit to carry energy from the circuit board to the ignitor; and a pressure responsive member which is selectively moveable from a closed position to an open position by the force or pressure generated by the activation module; wherein the insertable energy source container is capable of generating a force or pressure within the pressure chamber when activated by the activation circuit within the activation module, wherein the force or pressure passes through the pressure responsive member to move the pressure responsive member from the closed position to an open position, and wherein pressurized wellbore fluid is allowed to enter the tool thru an exposed passage in the pressure chamber, replacing the pressure generated by the insertable energy source and ensuring that the pressure responsive member remains in the open position due to an imbalance of forces on the pressure responsive member in a distal part of the pressure chamber below the pressure responsive member.

In some embodiments of the downhole actuator device, the device is configurable to be surface activated using externally attached components comprising: a wireline or e-line, an e-coil tubing, or a digital slickline.

In some embodiments of the downhole actuator device, the device is configurable to be pressure activated using additional internal components within the pressure chamber further comprising: an insertable power module and an insertable pressure actuation member, wherein the insertable power module comprises at least one battery or a plurality of batteries arranged in series or in parallel circuitry and wherein the insertable pressure actuation member comprises a pressure activated piston.

In some embodiments of the downhole actuator device, the pressure activated piston comprises a variable number of shear pins configured to release the pressure actuated piston at operator-selectable pressures.

In some embodiments of the downhole actuator device, the device is configurable for attachment to a crossover sub, or a top sub, or a bottom sub; or a crossover sub, a top sub and a bottom sub; or any combination thereof.

In some embodiments of the downhole actuator device, the device is further configurable to adapt to any one, or a plurality of conveyance mechanisms comprising: a slickline cable, a wireline cable, a coiled tubing, a drill pipe, a well tractor, a casing and a tubing.

Provided herein is a downhole actuator device for use in directing wellbore fluid to be used in performing work in a wellbore, said downhole actuator device comprising: a pressure chamber, insertable activation module comprising: an insertable energy source comprising: a non-explosive pyrotechnic; a custom logic circuit board, an integrated timer module on the circuit board, an ignitor and an activation circuit to carry energy from the circuit board to an ignitor; and a pressure responsive member which is selectively moveable from a closed position to an open position by the force or pressure generated by the activation module; wherein the insertable energy source container is capable of generating a force or pressure within the pressure chamber when activated by the activation circuit within the activation module, wherein the force or pressure passes through the pressure responsive member to move the pressure responsive member from the closed position to an open position, wherein pressurized wellbore fluid is allowed to enter the tool thru an exposed passage in the pressure chamber, replacing the pressure generated by the insertable energy source and ensuring that the pressure responsive member remains in the open position due to an imbalance of forces on the pressure responsive member in a distal part of the pressure chamber below the pressure responsive member, and wherein the downhole actuator is configurable for either surface activation through an electrical circuit sent down from the surface via wireline or comparable mechanism, or for downhole pressure activation with the addition of further internal features comprising an insertable power module and an insertable pressure actuation member.

Further still, provided herein is a downhole actuator device for use in directing wellbore fluid to be used in performing work in a wellbore, said downhole actuator device comprising: a pressure chamber, an insertable activation module comprising a gas chamber and activation mechanism capable of releasing a force or pressure within the pressure chamber when activated, and a pressure responsive member which is selectively moveable from a closed position to an open position by the force or pressure generated by said activation module; wherein, when said pressure responsive member moves from the closed position to an open position, wellbore fluid is allowed to enter the device thru an exposed passage in the pressure chamber distal to said pressure responsive member.

In some embodiments of the downhole actuator device, the insertable activation module comprises: an insertable gas energy source, a custom logic circuit board, an integrated timer module on said circuit board, an electro-mechanical activation mechanism, and an activation circuit to carry energy from the circuit board to the electro-mechanical activation mechanism.

In some embodiments of the downhole actuator device, the insertable energy source comprises: a non-explosive compressed gas container, or an inert gas container; wherein said insertable energy source is capable of releasing a force or pressure within the pressure chamber when activated by the electro-mechanical activation mechanism within the activation module, wherein said force or pressure passes through said pressure responsive member to move the pressure responsive member from the closed position to an open position and wherein pressurized wellbore fluid is allowed to enter the tool thru said exposed passage in the pressure chamber, replacing the pressure generated by the insertable energy source and ensuring that the pressure responsive member remains in the open position due to an imbalance of forces on the pressure responsive member in a distal part of the pressure chamber below the pressure responsive member.

In some embodiments of the downhole actuator device, the pressure responsive member comprises a spring-loaded pilot valve.

In some embodiments, the spring-loaded pilot valve is not pressure balanced and therefore the wellbore fluid is also trying to move the pilot valve.

In some embodiments of the downhole actuator device, the device is configurable to be adapted with an insertable power module and an insertable pressure actuation member within the pressure chamber, for pressure activation of the insertable activation module.

In some embodiments of the downhole actuator device, the device is configurable to adapt to a wireline or e-line, or an e-coil tubing, or a digital slickline for surface activation of the insertable activation module.

In some embodiments of the downhole actuator device, the device is configurable to adapt to a crossover sub, or a top sub, or a bottom sub; or a crossover sub, a top sub and a bottom sub; or any combination thereof.

In some embodiments of the downhole actuator device, the timer module comprises: a time keeping circuit using a microprocessor, microcontroller or other digital processor; or a counting circuit without a microprocessor, microcontroller or other processor, such as an oscillator or counter; or a time keeping circuit using an RC oscillator circuit.

In some embodiments of the downhole actuator device, an activation circuit within the insertable activation module comprises: an electrical conductor mechanism comprising a positive and negative terminal connection on a first end and a positive and negative terminal connection on a second end and a switch to connect the energy in the insertable power module to the electro-mechanical actuation mechanism; or a switch to connect the energy in the insertable power module to a power conversion circuit to step up the voltage to the electro-mechanical actuation mechanism; or a switch to connect the energy in the insertable power module to a power conversion circuit to step down the voltage to the electro-mechanical actuation mechanism; or transistor to connect the energy in the insertable power module to the electro-mechanical actuation mechanism; or a transistor to connect the energy in the insertable power module to a power conversion circuit to step up the voltage to the electro-mechanical actuation mechanism; or a transistor to connect the energy in the insertable power module to a power conversion circuit to step down the voltage to the electro-mechanical actuation mechanism; or relay to connect the energy in the insertable power module to the electro-mechanical actuation mechanism; or a relay to connect the energy in the insertable power module to a power conversion circuit to step up the voltage to the electro-mechanical actuation mechanism; or a relay to connect the energy in the insertable power module to a power conversion circuit to step down the voltage to the electro-mechanical actuation mechanism; or direct conductors between the positive terminals on the first end and the second end and the negative terminals on the first end and the second end.

In some embodiments of the downhole actuator device, the insertable power module comprises at least one battery.

In some embodiments of the downhole actuator device, the insertable power module comprises a plurality of batteries.

In some embodiments of the downhole actuator device, the at least one battery configuration of the insertable power module comprises a 1.5V battery, a 3V battery, a 3.7V battery, a 3.9V battery, a 4.5V battery, a 9V battery, an E battery, a PP3 battery, a 6LR61 battery, a 6F22 battery, a 1604A battery, a 1604D battery, a MN1604 battery, an A battery, a AA battery, a AAA battery, a B battery, a C battery, a D battery, a DD battery, an F battery, (commonly found in 6V rectangular lantern batteries), an aluminum-air battery, a lithium-ion battery, a lithium polymer battery, an alkaline battery, a lead-acid battery, a nickel battery, a nickel-cadmium battery, a nickel-metal hydride battery, or a solid-state composition battery.

In some embodiments of the downhole actuator device, the configuration of the insertable power module with a plurality of batteries comprises a plurality of 1.5V batteries, a plurality of 3V batteries, a plurality of 3.7V batteries, a plurality of 3.9V batteries, a plurality of 4.5V batteries, a plurality of 9V batteries, a plurality of E batteries, a plurality of PP3 batteries, a plurality of 6LR61 batteries, a plurality of 6F22 batteries, a plurality of 1604A batteries, a plurality of 1604D batteries, a plurality of MN1604 batteries, a plurality of A batteries, a plurality of AA batteries, a plurality of AAA batteries, a plurality of B batteries, a plurality of C batteries, a plurality of D batteries, a plurality of DD batteries, a plurality of F batteries, (commonly found in 6V rectangular lantern batteries), a plurality of aluminum-air batteries, a plurality of lithium-ion batteries, a plurality of lithium polymer batteries, a plurality of alkaline batteries, a plurality of lead-acid batteries, a plurality of nickel batteries, a plurality of nickel-cadmium batteries, a plurality of nickel-metal hydride batteries, or a plurality of solid-state composition batteries.

In some embodiments of the downhole actuator device, the insertable power module comprises a plurality of batteries arranged in series circuitry.

In some embodiments of the downhole actuator device, the insertable power module comprises a plurality of batteries arranged in parallel circuitry.

In some embodiments of the downhole actuator device, the insertable power module comprises a plurality of batteries arranged in series-parallel circuitry.

In some embodiments of the downhole actuator device, the insertable pressure actuation member comprises a pressure activated piston.

In some embodiments of the downhole actuator device, the pressure actuated piston comprises a variable number of shear pins configured to release the pressure actuated piston at operator-selectable pressures.

In any one of the embodiments, the downhole actuator device, is configurable to adapt to any one of or a plurality of conveyance mechanisms for downhole delivery and/or retrieval comprising: a slickline cable, a wireline cable, a coiled tubing, a drill pipe, a well tractor, a casing, or a tubing.

Provided herein is a downhole actuator device for use in directing wellbore fluid to be used in performing work in a wellbore, said downhole actuator device comprising: a pressure chamber, insertable activation module comprising: an insertable energy source comprising: a non-explosive compressed gas container or an inert gas container; a custom logic circuit board, an integrated timer module on said circuit board, an electro-mechanical activation mechanism and an activation circuit to carry energy from the circuit board to the electro-mechanical activation mechanism; and a pressure responsive member which is selectively moveable from a closed position to an open position by the force or pressure generated by said activation module; wherein said insertable energy source container is capable of releasing a force or pressure within the pressure chamber when activated by the activation circuit and electro-mechanical activation mechanism within the activation module, wherein said force or pressure passes through said pressure responsive member to move the pressure responsive member from the closed position to an open position, and wherein pressurized wellbore fluid is allowed to enter the tool thru an exposed passage in the pressure chamber, replacing the pressure generated by the insertable energy source and ensuring that the pressure responsive member remains in the open position due to an imbalance of forces on the pressure responsive member in a distal part of the pressure chamber below the pressure responsive member.

In some embodiments of the downhole actuator device, the device is configurable to be surface activated using externally attached components comprising: a wireline or e-line, an e-coil tubing, or a digital slickline.

In some embodiments of the downhole actuator device, the device is configurable to be pressure activated using additional internal components within the pressure chamber further comprising: an insertable power module and an insertable pressure actuation member, wherein the insertable power module comprises at least one battery or a plurality of batteries arranged in series or in parallel circuitry and wherein the insertable pressure actuation member comprises a pressure activated piston.

In some embodiments of the downhole actuator device, the pressure activated piston comprises a variable number of shear pins configured to release the pressure actuated piston at operator-selectable pressures.

In some embodiments of the downhole actuator device, the device is configurable for attachment to a crossover sub, or a top sub, or a bottom sub; or a crossover sub, a top sub and a bottom sub; or any combination thereof.

In some embodiments of the downhole actuator device, the device is further configurable to adapt to any one, or a plurality of, conveyance mechanisms comprising: a slickline cable, a wireline cable, a coiled tubing, a drill pipe, a well tractor, a casing and a tubing.

Provided herein is a downhole actuator device for use in directing wellbore fluid to be used in performing work in a wellbore, said downhole actuator device comprising: a pressure chamber, insertable activation module comprising: an insertable energy source comprising: a non-explosive compressed gas container or an inert gas container; a custom logic circuit board, an integrated timer module on said circuit board, a solenoid activation mechanism and an activation circuit to carry energy from the circuit board to the solenoid; and a pressure responsive member which is selectively moveable from a closed position to an open position by the force or pressure generated by said activation module; wherein said insertable energy source container is capable of releasing a force or pressure within the pressure chamber when activated by the activation circuit and electro-mechanical activation mechanism within the activation module, wherein said force or pressure passes through said pressure responsive member to move the pressure responsive member from the closed position to an open position, wherein pressurized wellbore fluid is allowed to enter the tool thru an exposed passage in the pressure chamber, replacing the pressure generated by the insertable energy source and ensuring that the pressure responsive member remains in the open position due to an imbalance of forces on the pressure responsive member in a distal part of the pressure chamber below the pressure responsive member, and wherein said downhole actuator is configurable for either surface activation through an electrical circuit sent down from the surface via wireline or comparable mechanism, or for downhole pressure activation with the addition of further internal features comprising an insertable power module and an insertable pressure actuation member.

Additional aspects and advantages of the present disclosure will become readily apparent to those skilled in this art from the following detailed description, wherein only exemplary embodiments of the present disclosure are shown and described, simply by way of illustration of the several modes or best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIG. 3-B is an exemplary cross-section view of the entire solenoid-type pressure activated trigger of FIG. 3-A in a further intermediate state following activation of the timer.

FIG. 5-B is an exemplary bottom view of the solenoid trigger activation printed circuit board of the downhole actuation device.

FIG. 5-C is an exemplary side view of the solenoid trigger activation printed circuit board of the downhole actuation device.

FIG. 19-B is an exemplary cross-section view of an entire non-explosive gas-type pressure activated trigger of FIG. 19-A in its final state following the shift of the pressure responsive pilot valve from its initially closed position to its final open position.

FIG. 21-B is an exemplary cross-section view of the entire non-explosive gas-type surface activated trigger of FIG. 21-A in its final state following the shift of the pressure responsive pilot valve from its initially closed position to its final open position.

Figure 1:
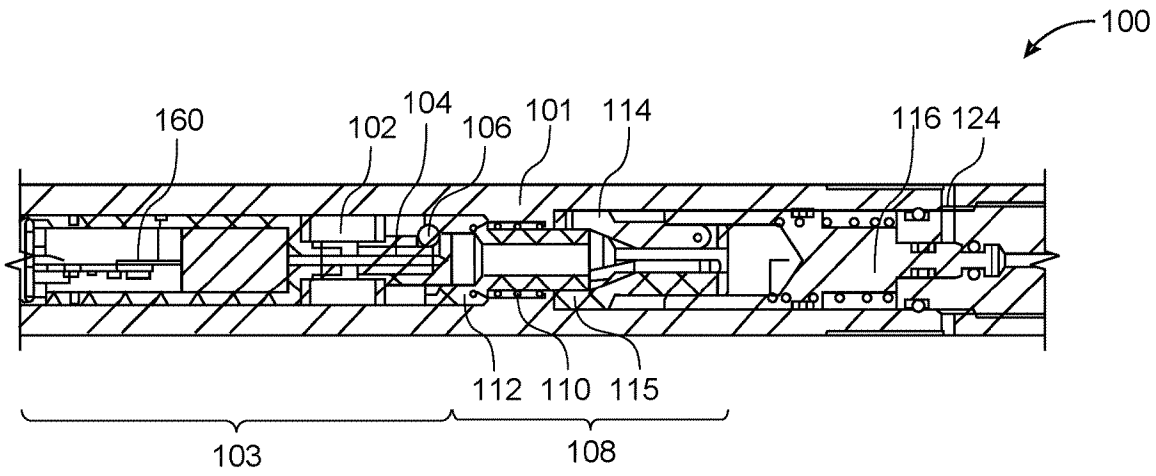
FIG. 1 is an exemplary cross-section view of a solenoid-type trigger's core components of the downhole actuation device for use to perform work in a wellbore.

The foregoing and other features of the present disclosure will become apparent from the following description and appended claims, taken in conjunction with the accompanying drawings.

Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF THE INVENTION

While preferred embodiments of the present invention have been shown and described herein, it will be obvious to those skilled in the art that such embodiments are provided by way of example only. Numerous variations, changes, and substitutions will now occur to those skilled in the art without departing from the invention, in accordance with the claims. It should be understood that various alternatives to the embodiments of the invention described herein may be employed in practicing the invention.

While the making and using of various embodiments of the present invention are discussed in detail below, it should be appreciated that the present invention provides many applicable inventive concepts, which can be embodied in a wide variety of specific contexts.

Various embodiments of the time-delayed, downhole trigger and methods of use will now be described with reference to the accompanying drawings, wherein like reference numerals and or labels are used for like features throughout the several views. The detailed description set forth below in connection with the appended drawings is intended as a description of exemplary embodiments in which the presently disclosed subject matter can be practiced. The specific embodiments discussed herein are merely illustrative of specific ways to make and use the invention, and do not delimit the scope of the invention. The term "exemplary" used throughout this description means "serving as an example, instance, or illustration," and should not necessarily be construed as preferred or advantageous over other embodiments. The detailed description includes specific details for providing a thorough understanding of the presently disclosed device, method and system. However, it will be apparent to those skilled in the art that the presently disclosed subject matter may be practiced without these specific details. In some instances, well-known structures and devices are shown in functional or conceptual diagram form in order to avoid obscuring the concepts of the presently disclosed method and system. Certain terms are used throughout the following description and claims to refer to particular assembly components. This document does not intend to distinguish between components that differ in name but not function.

As used herein, and unless otherwise specified, the term "about" or "approximately" means an acceptable error for a particular value as determined by one of ordinary skill in the art, which depends in part on how the value is measured or determined. In certain embodiments, the term "about" or "approximately" means within 1, 2, 3, or 4 standard deviations. In certain embodiments, the term "about" or "approximately" means within 30%, 25%, 20%, 15%, 10%, 9%, 8%, 7%, 6%, 5%, 4%, 3%, 2%, 1%, 0.5%, 0.1%, or 0.05% of a given value or range. In certain embodiments, the term "about" or "approximately" means within 40.0 mm, 30.0 mm, 20.0 mm, 10.0 mm 5.0 mm 1.0 mm, 0.9 mm, 0.8 mm, 0.7 mm, 0.6 mm, 0.5 mm, 0.4 mm, 0.3 mm, 0.2 mm or 0.1 mm of a given value or range. In certain embodiments, the term "about" or "approximately" means within 5.0 kg, 2.5 kg, 1.0 kg, 0.9 kg, 0.8 kg, 0.7 kg, 0.6 kg, 0.5 kg, 0.4 kg, 0.3 kg, 0.2 kg or 0.1 kg of a given value or range, including increments therein. In certain embodiments, the term "about" or "approximately" means within 1 hour, within 45 minutes, within 30 minutes, within 25 minutes, within 20 minutes, within 15 minutes, within 10 minutes, within 5 minutes, within 4 minutes, within 3 minutes within 2 minutes, or within 1 minute. In certain embodiments, the term "about" or "approximately" means within 20.0 degrees, 15.0 degrees, 10.0 degrees, 9.0 degrees, 8.0 degrees, 7.0 degrees, 6.0 degrees, 5.0 degrees, 4.0 degrees, 3.0 degrees, 2.0 degrees, 1.0 degrees, 0.9 degrees, 0.8 degrees, 0.7 degrees, 0.6 degrees, 0.5 degrees, 0.4 degrees, 0.3 degrees, 0.2 degrees, 0.1 degrees, 0.09 degrees. 0.08 degrees, 0.07 degrees, 0.06 degrees, 0.05 degrees, 0.04 degrees, 0.03 degrees, 0.02 degrees or 0.01 degrees of a given value or range, including increments therein.

As used herein, and unless otherwise specified, the term "plurality," and like terms, refers to a number (of things) comprising at least one (thing), or greater than one (thing), as in "two or more" (things), "three or more" (things), "four or more" (things), etc.

As used herein, the terms "connected", "operationally connected", "coupled", "operationally coupled", "operationally linked", "operably connected", "operably coupled", "operably linked," and like terms, refer to a relationship (mechanical or electrical linkage, coupling, etc.) between elements whereby operation of one element results in a corresponding, following, or simultaneous operation or actuation of a second element. It is noted that in using said terms to describe inventive embodiments, specific structures or mechanisms that link or couple the elements are typically described. However, unless otherwise specifically stated, when one of said terms is used, the term indicates that the actual linkage or coupling may take a variety of forms, which in certain instances will be readily apparent to a person of ordinary skill in the relevant technology.

The term "axial" as used here refers to a direction or position along an axis that is parallel to a main or longitudinal axis.

As used herein, the terms "comprises," "comprising," or any other variation thereof, are intended to cover a nonexclusive inclusion, such that a process, method, article, or apparatus that comprises a list of elements does not include only those elements but may include other elements not expressly listed or inherent to such process, method, article, or apparatus.

As used herein, and unless otherwise specified, the terms "superior" and "proximal" mean the opposite of "inferior" and "distal". It may also mean situated above or directed upward from or to an apparatus or structure.

As used herein, and unless otherwise specified, the terms "inferior" and "distal" mean the opposite of superior and proximal. It may also mean situated below or directed downward from or to an apparatus or structure.

As used herein, the term "proximity" means nearness in space or relationship, but not excluding the potential to be touching. Proximity is also alternatively meant to mean that one thing may be so close to another thing as to be "in direct or nearly direct contact" (in proximity) with another thing along some point. To "place something in proximity" is also meant to mean that items are "paired" or "mated together" either in their paired function or at some point of contact.

As used herein, and unless otherwise specified, the term "helix" means an object having a three-dimensional shape like that of a wire wound uniformly in a single layer around a cylinder or cone, as in a corkscrew or spiral staircase. Alternative synonymous terms may comprise spiral corkscrew, curl, curlicue, twist, gyre, whorl, convolution, etc. Geometrically a helix, as used herein can also mean a curve on a conical or cylindrical surface that would become a straight line if the surface were unrolled into a plane.

As used herein, and unless otherwise specified, the term "vertically oriented" and similar terms mean; generally perpendicular to, at, or near, right angles to a horizontal plane; in a direction or having an alignment such that the top of a thing is above the bottom. In certain embodiments, the term "vertically oriented" means within ±20.0 degrees, ±15.0 degrees, ±10.0 degrees, +9.0 degrees, ±8.0 degrees, ±7.0 degrees, ±6.0 degrees, ±5.0 degrees, ±4.0 degrees, ±3.0 degrees, ±2.0 degrees, ±1.0 degrees, ±0.9 degrees, ±0.8 degrees, ±0.7 degrees, ±0.6 degrees, ±0.5 degrees, ±0.4 degrees, ≡0.3 degrees, ±0.2 degrees or ±0.1 degrees of a given value or range, generally perpendicular to, at, or near, right angles to a horizontal plane, including increments therein.

As used herein, and unless otherwise specified, the term "horizontally oriented" and similar terms mean; generally perpendicular to, at, or near, right angles to a vertical plane; in a direction or having an alignment such that the top of a thing is generally on, or near the same plane as the bottom, both being parallel or near parallel to the horizon. In certain embodiments, the term "horizontally oriented" means within ±20.0 degrees, ±15.0 degrees, ±10.0 degrees, ±9.0 degrees, ±8.0 degrees, ±7.0 degrees, ±6.0 degrees, ±5.0 degrees, ±4.0 degrees, ±3.0 degrees, ±2.0 degrees, ±1.0 degrees, ±0.9 degrees, ±0.8 degrees, ±0.7 degrees, ±0.6 degrees, ±0.5 degrees, ±0.4 degrees, ±0.3 degrees, ±0.2 degrees or ±0.1 degrees of a given value or range, generally perpendicular to, at, or near, right angles to a vertical plane, including increments therein.

As used herein, and unless otherwise specified, the term "substantially perpendicular" and similar terms mean generally at or near 90 degrees to a given line, or surface or to the ground. In certain embodiments, the term "substantially perpendicular" means within ±20.0 degrees, ±15.0 degrees, ±10.0 degrees, ±9.0 degrees, ±8.0 degrees, ±7.0 degrees, ±6.0 degrees, ±5.0 degrees, ±4.0 degrees, ±3.0 degrees, ±2.0 degrees, ±1.0 degrees, ±0.9 degrees, ±0.8 degrees, ±0.7 degrees, ±0.6 degrees, ±0.5 degrees, ±0.4 degrees, ±0.3 degrees, ±0.2 degrees or ±0.1 degrees of a given value or range, including increments therein.

As used herein, whenever the term "at least," "greater than," or "greater than or equal to" precedes the first numerical value in a series of two or more numerical values, the term "at least," "greater than" or "greater than or equal to" applies to each of the numerical values in that series of numerical values. For example, greater than or equal to 1, 2, or 3 is equivalent to greater than or equal to 1, greater than or equal to 2, or greater than or equal to 3.

As used herein, whenever the term "no more than," "less than," or "less than or equal to" precedes the first numerical value in a series of two or more numerical values, the term "no more than," "less than," or "less than or equal to" applies to each of the numerical values in that series of numerical values. For example, less than or equal to 3, 2, or 1 is equivalent to less than or equal to 3, less than or equal to 2, or less than or equal to 1.

In accordance with the description herein, suitable digital processing devices include, by way of non-limiting examples, microprocessors, microcontrollers, server computers, desktop computers, laptop computers, notebook computers, sub-notebook computers, netbook computers, netpad computers, set-top computers, handheld computers, Internet appliances, mobile smartphones, tablet computers, personal digital assistants, video game consoles, and vehicles. Those of skill in the art will recognize that many smartphones are suitable for use in the system described herein. Those of skill in the art will also recognize that select televisions, video players, and digital music players with optional computer network connectivity are suitable for use in the system described herein. Suitable tablet computers include those with booklet, slate, and convertible configurations, known to those of skill in the art.

In some embodiments, the digital processing device includes an operating system configured to perform executable instructions. The operating system is, for example, software, including programs and data, which manages the device's hardware and provides services for execution of applications. Those of skill in the art will recognize that suitable server operating systems include, by way of non-limiting examples, FreeBSD, OpenBSD, NetBSD®, Linux, Apple® Mac OS X Server®, Oracle® Solaris®, Windows Server®, and Novell® NetWare®. Those of skill in the art will recognize that suitable personal computer operating systems include, by way of non-limiting examples, Microsoft® Windows®, Apple® Mac OS X®, UNIX®, and UNIX-like operating systems such as GNU/Linux®. In some embodiments, the operating system is provided by cloud computing. Those of skill in the art will also recognize that suitable mobile smart phone operating systems include, by way of non-limiting examples, Nokia® Symbian® OS, Apple® iOS®, Research In Motion® BlackBerry OS®, Google® Android®, Microsoft® Windows Phone® OS, Microsoft® Windows Mobile® OS, Linux®, and Palm® WebOS®.

In some embodiments, the device includes a storage and/or memory device. The storage and/or memory device is one or more physical apparatus used to store data or programs on a temporary or permanent basis. In some embodiments, the device is volatile memory and requires power to maintain stored information. In some embodiments, the device is non-volatile memory and retains stored information when the digital processing device is not powered. In some embodiments, the non-volatile memory comprises flash memory. In some embodiments, the non-volatile memory comprises dynamic random-access memory (DRAM). In some embodiments, the non-volatile memory comprises ferroelectric random-access memory (FRAM). In some embodiments, the non-volatile memory comprises phase-change random access memory (PRAM). In some embodiments, the device is a storage device including, by way of non-limiting examples, CD-ROMs, DVDs, flash memory devices, magnetic disk drives, magnetic tapes drives, optical disk drives, and cloud computing-based storage. In some embodiments, the storage and/or memory device is a combination of devices such as those disclosed herein.

As used herein, and unless otherwise specified, the term "Downhole Actuator device," and like terms, refers to a control mechanism that is operated by an energy source. This energy, which may include; hydraulic pressure, pneumatic pressure, mechanical pressure, thermodynamic pressure, solenoid, or electric current; moves the internal mechanical parts of the actuator. Actuators can be designed to fail open (in the case of actuator failure, the valve will stay open) or fail close (in the case of actuator failure, the valve will stay closed).

As used herein, and unless otherwise specified, the term "wellbore," and like terms, refers to a hole that is drilled to aid in the exploration and recovery of natural resources, including oil, gas, or water. A wellbore is the actual hole that forms the well.

As used herein, and unless otherwise specified, the term "atmospheric chamber," "pressure chamber" and like terms, refers to the actuator device housing. In certain embodiments, the term "atmospheric chamber" or "pressure chamber" includes, a first opposing wall of the chamber and a second opposing wall of the chamber, end members sealingly joining the first and second opposing walls of the chamber to create a fluid tight volumetric space, and at least one passage substantially bridging between the first opposing wall and the second opposing wall positioned between respective end members.

As used herein, and unless otherwise specified, the term "Pressure actuation member," and like terms, refers to a piston, positioned superior to the power module and connection terminals or electrical switch and configured to create a closed electrical circuit when activated and moved from a first position to a second position where contact is made with connection terminals for a power module.

As used herein, and unless otherwise specified, the term "Power Module," and like terms, refers to a battery or grouping of batteries, typically configured to power a activation circuit and an ignitor or initiator. In certain embodiments, the terms "primary" or "secondary" are used to describe the battery configuration. As used herein, and unless otherwise specified, the term "primary battery" refers to a non-rechargeable battery. As used herein, and unless otherwise specified, the term "secondary battery" refers to a rechargeable battery. In any given embodiment, the power module can comprise either primary batteries, secondary batteries or a combination of both primary and secondary batteries.

As used herein, and unless otherwise specified, the term "Electrical Conductor Mechanism," and like terms, refers to a positive and negative wiring combination, electrical terminal combinations or electrical switch.

As used herein, and unless otherwise specified, the terms "Timer" "Timer Circuit," "Time Keeping Circuit" and like terms, refers to a time keeping circuit using a microprocessor, microcontroller or processor to count time. Alternately, the time keeping circuit can be configured using a RC Circuit. Further still, the timer circuit can be a counting circuit without a microprocessor, microcontroller or other processor, such as an oscillator or counter.

As used herein, and unless otherwise specified, the term "Actuation Member," refers to a non-pyrotechnic "Ignitor;" a device for lighting or igniting a fuel source. Examples of ignitors intended for use herein include but are not limited to an electric match, an electronic ignition, a piezo ignition and a resistance ignitor. The fuel source can be any combustible material, a slow or fast burning pyrotechnic material or solid propellant fuel source comprising a mixture of various chemicals, such as used in a pyrotechnic device. Examples of mixtures of various chemicals intended for use herein, include but are not limited to black powder, sulfur, charcoal, potassium nitrate, etc. Alternately, the term "Actuation Member" refers to an "Initiator;" a device for activating an energy source, other than a pyrotechnic device.

As used herein, and unless otherwise specified, the term "sear" or "sear arm" refers to a component or plurality of components of a mechanical trigger mechanism that holds or constrains an outer sleeve of a pressure responsive pilot valve. In a firearm, the sear is the part of the trigger mechanism that holds the hammer, striker, or bolt back until the correct amount of pressure has been applied to the trigger, at which point the hammer, striker, or bolt is released to discharge the weapon. In this application, the sear arms work in a similar fashion wherein the arms are loaded by the spring-loaded pilot valve which is only allowed to move once the sear arms retract due to becoming unsupported by movement of a spring-loaded trigger sleeve that is constrained by a dog supporting solenoid. Once the solenoid activates and retracts its plunger, the dogs become unsupported which allows the spring-loaded trigger sleeve to shift thereby un-supporting the sear arms allowing them to collapse which in turn un-constrains the movement of the spring-loaded, pressure responsive pilot valve member.

Further, as used herein "trigger balls, "trigger dogs," "ball or balls," and "dog or dogs" and like terms refer to restraining components of the mechanical trigger mechanism which prevent the trigger sleeve from activating until the solenoid plunger is activated, allowing the restraining balls or dogs to drop away and unconstrain the trigger collar and releasing the sear arms.

As used herein, the term "Actuation Mechanism," may refer to a mechanical trigger.

Examples of a mechanical trigger intended for use herein include but are not limited to a mechanical device comprising a spring-loaded sleeve, at least one Sear arm, and often two, three or more Sear arms, constraining a pilot valve adjacent and operably coupled thereto. Alternately, the term "Actuation Mechanism," may refer to a pressure activated piston, such as one configured with a shear sleeve.

As used herein, and unless otherwise specified, the term "compressed gas" and like terms, refers to any non-explosive gas or inert gas capable of performing the functions described herein, such as, but not limited to $CO_2$, Nitrogen, Argon, Helium or compressed air.

As used herein, and unless otherwise specified, the term "Activation Mechanism," may refer to a solenoid or puncture mechanism. Alternately, an activation mechanism may include an ignitor for use with a non-explosive pyrotechnic device such as a rocket engine. Examples of a solenoid, plunger or puncture mechanism intended for use herein include but are not limited to a mechanical device for activating a compressed gas chamber or cartridge. Further still, a PCB may provide components thereon to act as an Activation Mechanism, such as an activation circuit with or without a timer module.

As used herein, and unless otherwise specified, the term "wireline," "e-line," or similar terms refers to any aspect of logging that employs an electrical cable to lower tools into the borehole and to transmit data. Wireline logging is distinct from measurements-while-drilling (MWD) and mud logging.

As used herein, and unless otherwise specified, the term "slickline," or similar terms refers to any aspect of logging that employs cables NOT incorporating electrical conductors. Similarly, the term slickline is commonly used to differentiate operations performed with single-strand wire or braided lines. Commonly used to place and recover wellbore equipment, such as plugs, gauges and valves, slicklines are single-strand non-electric cables lowered into oil and gas wells from the surface. Slicklines can also be used to adjust valves and sleeves located downhole, as well as repair tubing within the wellbore. Wrapped around a drum on the back of a truck, the slickline is raised and lowered in the well by reeling in and out the wire hydraulically.

As used herein, and unless otherwise specified, the term "Pressure Responsive Member," "Force-Pressure Responsive Member," and like terms, refers to Pilot Valves which are commonly unidirectional, and acted upon by one or more pressure sources from within or external to the tool. In the described embodiments, pressure generated from within the tool functions to shift the pilot valve from a closed position to an open position, allowing highly pressurized downhole fluid from the exterior of the tool to enter the interior of the tool thus allowing the fluid to be redirected to various mechanical and/or hydraulic components above or below said tool. In some embodiments, the pilot valve is not pressure balanced and therefore the wellbore fluid is also trying to move the pilot valve counter to or in conjunction with a pilot valve spring. A "Force-Pressure Responsive Member" may also mean a pilot valve acted upon by an electro-mechanical solenoid. For example: In a rocket engine or compressed gas version of the downhole trigger, the spring acts to keep the valve closed so the pressure from either the C02 (for example) or rocket engine must overcome the spring force to open. Once opened, the hydrostatic pressure from the well will keep it opened. Whereas, with a solenoid version of the downhole trigger, the spring acts to keep the valve open, but it is restrained by the sear arms in the trigger mechanism.

The present disclosure details a system for a different, more dependable, more precise and cost-effective triggering and actuation mechanism. The disclosed apparatus does not use specific pressures or other well parameters to trigger a setting device, but rather uses a combination of pressure and independent time-delayed actuation to trigger the function of the tool.

A downhole actuator device is provided for use in directing wellbore fluid to be used in performing work in a wellbore by converting a pressure source into a force exerted over a distance. The core components of the downhole actuator device include a pressure chamber containing an insertable activation module, an insertable pressure source module capable of releasing a pressure or force and a pressure responsive member. The core components of the pressure source module can include one or more of a plurality of optional formats for delivery of the force comprising a solenoid and a mechanical trigger, a non-explosive pyrotechnic device insert, or a charged gas module insert, which, when appropriately combined, sequenced and activated, will open a pressure responsive member that will allow wellbore fluid, at hydrostatic pressure, to enter the tool thereby providing the energy needed to actuate various mechanical and/or hydraulic components downhole. Multiple variations of the device are provided to allow for either pressure activated or surface activated variations of the device. Additional variable components may include a timer circuit, a power module, a proximal pressure actuated piston, various sub connections, a wireline or slickline cable. Downhole delivery of the device is achievable by a plurality of commonly known mechanisms.

Figure 2:
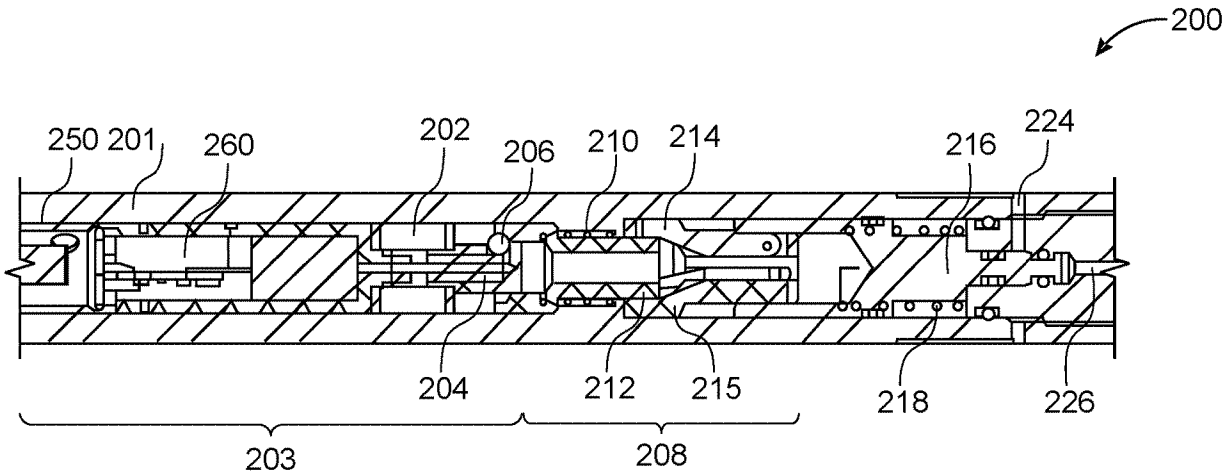
FIG. 2 is an exemplary detailed cross-section view of the core components of a solenoid-type pressure activated trigger of the downhole actuation device as configured for pressure activation.

Referring now to FIGS. 1 and 2, provided herein is a downhole actuator device 100 for use in directing wellbore fluid to be used in performing work in a wellbore, the core components of the downhole actuator device comprising: a pressure chamber 101; an insertable activation module 103; a mechanical trigger 108 capable of releasing a force or pressure within the pressure chamber when activated by the insertable activation module; and a pressure responsive member 116 which is selectively moveable from a closed position to an open position by said activation module and mechanical trigger; wherein, when the pressure responsive member moves from a closed position to an open position, wellbore fluid is allowed to enter the device thru an exposed passage 124 in the pressure chamber distal to said pressure responsive member.

In some embodiments, the insertable activation module 103 comprises: an electro-mechanical activation mechanism 102; a custom logic circuit board 160; an integrated timer module on said circuit board (not shown); and an activation circuit (not shown) to carry energy from the circuit board 160 to the electro-mechanical activation mechanism 102.

In some embodiments, the mechanical trigger 108 comprises: a plurality of retainer balls or dogs 106 held in place by a plunger 104 associated with the electro-mechanical activation mechanism 102; a trigger sleeve 112; a trigger sleeve spring 110; a sear arm housing 115 within the mechanical trigger; and a plurality of sear arms 114; wherein the plurality of retainer dogs are configured to drop away in order to unconstrain the trigger sleeve when the electro-mechanical activation mechanism activates; thus when the trigger sleeve moves toward the electro-mechanical activation mechanism due to the sleeve spring, thus releasing the constrained sear arms, the sear arms collapse within the sear arm housing and allow the pressure responsive member 116 to move from a closed position to an open position.

In some embodiments of the downhole actuator device 100, the electro-mechanical activation mechanism 103 comprises a solenoid 102 with a plunger 104.

In some embodiments, the retainer dogs are spherical balls 106.

In some embodiments, the pressure responsive member 116 comprises a spring-loaded pilot valve.

In some embodiments, the spring-loaded pilot valve is not pressure balanced with a spring or like mechanism and therefore the wellbore fluid is also trying to move the pilot valve.

Figure 3A:
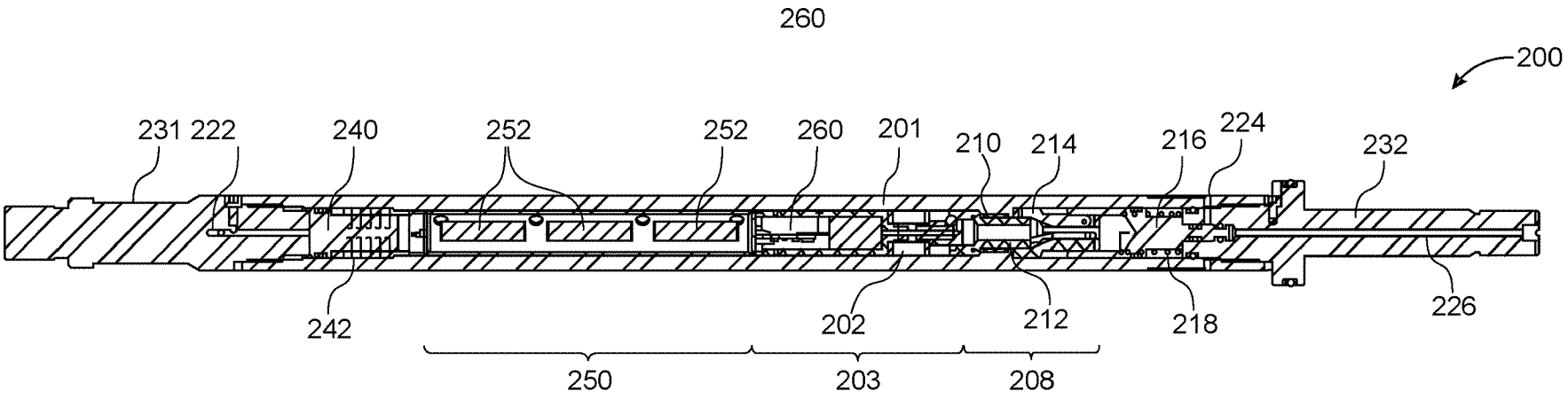
FIG. 3-A is an exemplary detailed cross-section view of an entire solenoid-type pressure activated trigger of the downhole actuation device in its initial state before pressure activation.
Figure 3B:
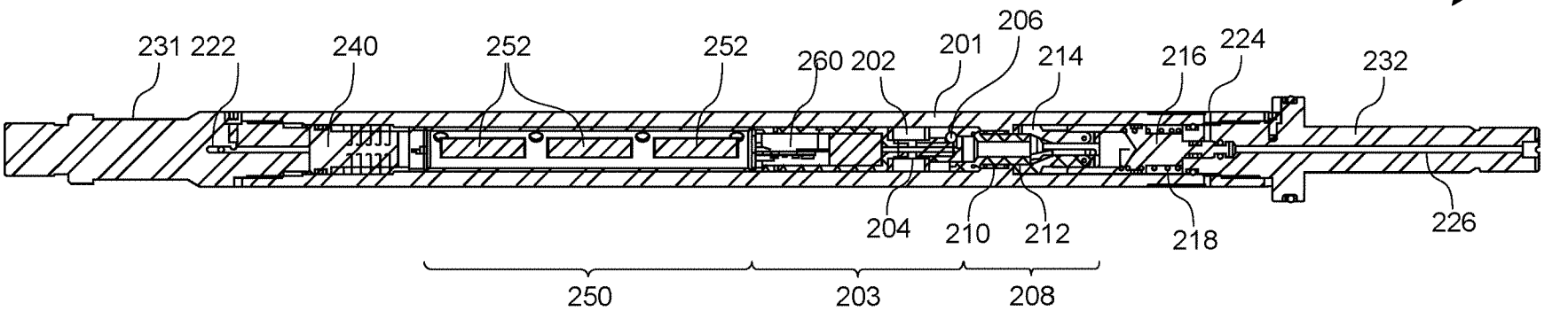
Figure 4:
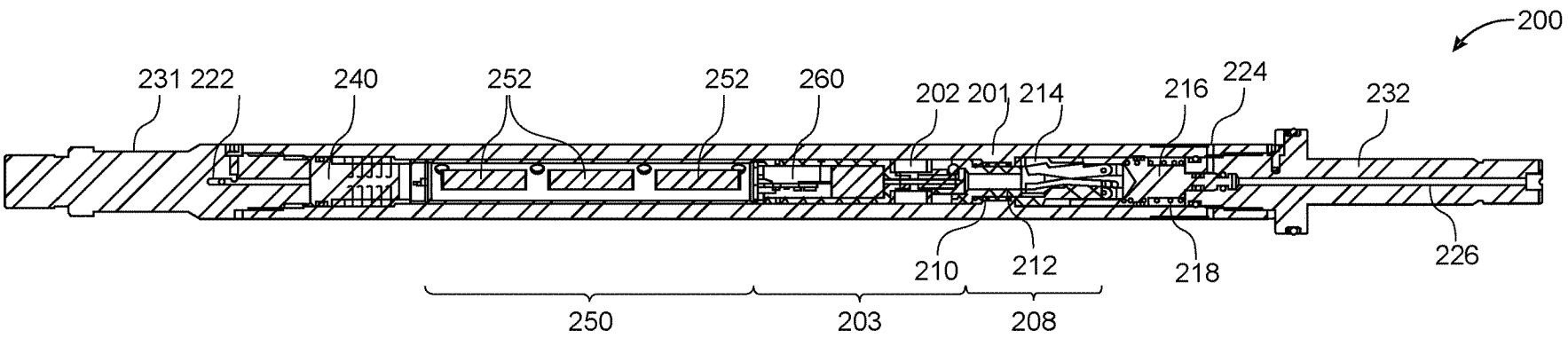
FIG. 4 is an exemplary detailed cross-section view of the entire solenoid-type pressure activated trigger of FIG. 3-B in its final state following the collapse of the sear arms and shift of the pressure responsive pilot valve from its initially closed position to its final open position.

Referring now to FIGS. 2 through 4, in some embodiments, the downhole actuator device 200 is configurable to be adapted with an insertable power module 250 for use as a pressure activated triggering device and an insertable pressure actuation member 240, within the pressure chamber, for pressure activation of the insertable activation module 203.

In some embodiments of the downhole actuator device, the pressure actuated piston comprises a variable number of shear pins configured to release the pressure actuated piston at operator-selectable pressures. Further still, in some embodiments the insertable pressure actuation member 240 is configurable with calibrated or preset shear pins, often fitted within a shear sleeve 242, to allow an operator to preset a downhole pressure or depth for remote activation of the device when the pressure detected through the proximal external port 222 reaches the preset pressure.

In some embodiments, the downhole actuator device is configurable to adapt to a slickline (not shown), usually in association with a cable head or connecting sub (i.e.: 230, 231). In some embodiments, the downhole actuator device is configurable to adapt to a cable head 230, a top sub 231, a bottom sub 232; or a crossover sub, a top sub and a bottom sub; or any combination thereof in combination with a slickline for delivery and/or retrieval of the device to or from a prescribed depth in a downhole bore.

In some embodiments of the downhole actuator device 200, the timer module incorporated into the timer activation PCB 260, further described later herein comprises: a time keeping circuit using a microprocessor, microcontroller or other digital processor; or a counting circuit without a microprocessor, microcontroller or other processor, such as an oscillator or counter; or a time keeping circuit using an RC (resistor-capacitor) oscillator circuit. One skilled in the art will readily recognize the multiple possible configurations possible for such a time keeping circuit based on this description.

In some embodiments of the downhole actuator device 200, an activation circuit 260 within the insertable activation module comprising a power module 250, as further described in FIG. 6 later herein comprises: an electrical conductor mechanism comprising a positive and negative terminal connection, on a first end and a positive and negative terminal connection on a second end; and

- a switch to connect the energy in the insertable power module to the electro-mechanical actuation mechanism; or
- a switch to connect the energy in the insertable power module to a power conversion circuit to step up the voltage to the electro-mechanical actuation mechanism; or
- a switch to connect the energy in the insertable power module to a power conversion circuit to step down the voltage to the electro-mechanical actuation mechanism; or
- transistor to connect the energy in the insertable power module to the electro-mechanical actuation mechanism; or
- a transistor to connect the energy in the insertable power module to a power conversion circuit to step up the voltage to the electro-mechanical actuation mechanism; or
- a transistor to connect the energy in the insertable power module to a power conversion circuit to step down the voltage to the electro-mechanical actuation mechanism; or
- relay to connect the energy in the insertable power module to the electro-mechanical actuation mechanism; or a relay to connect the energy in the insertable power module to a power conversion circuit to step up the voltage to the electro-mechanical actuation mechanism; or a relay to connect the energy in the insertable power module to a power conversion circuit to step down the voltage to the electro-mechanical actuation mechanism.

Figure 5A:
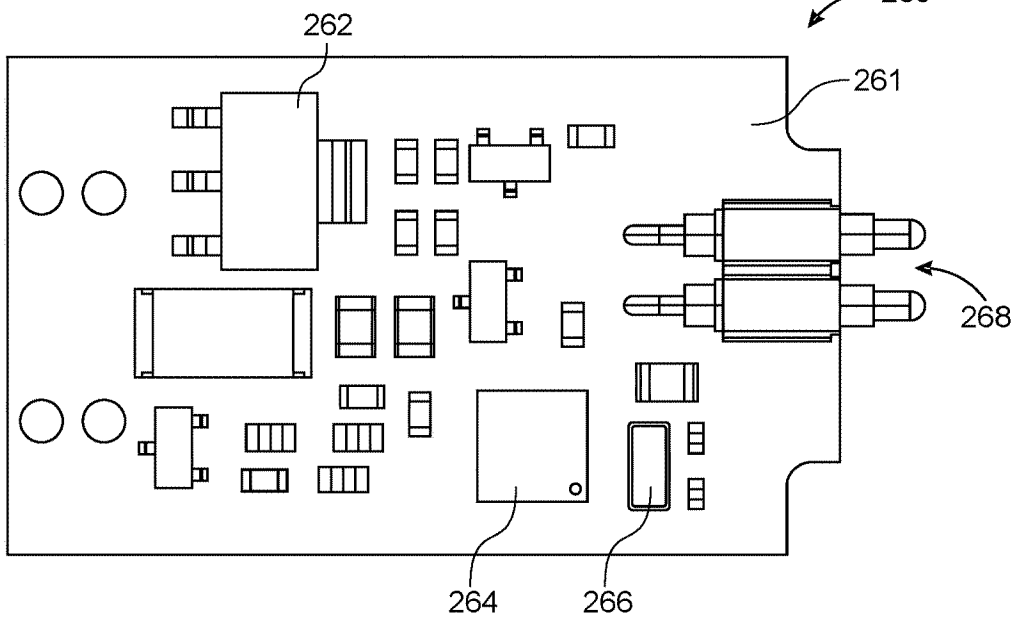
FIG. 5-A is an exemplary top view of the solenoid trigger activation printed circuit board of the downhole actuation device.
Figure 5B:
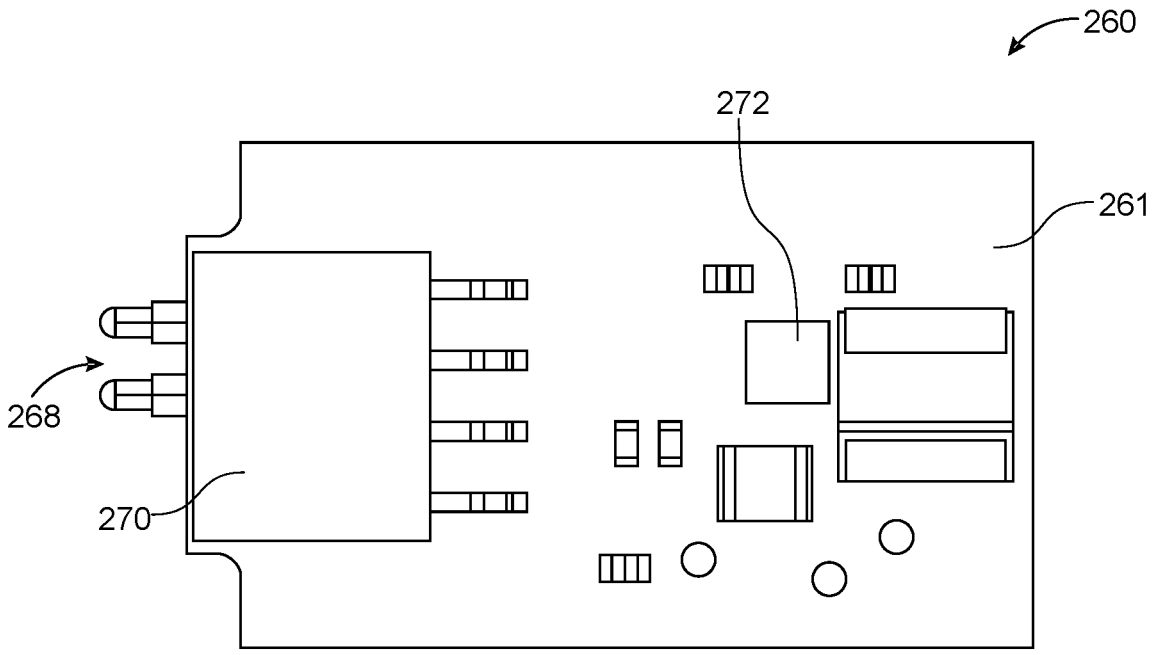
Figure 5C:
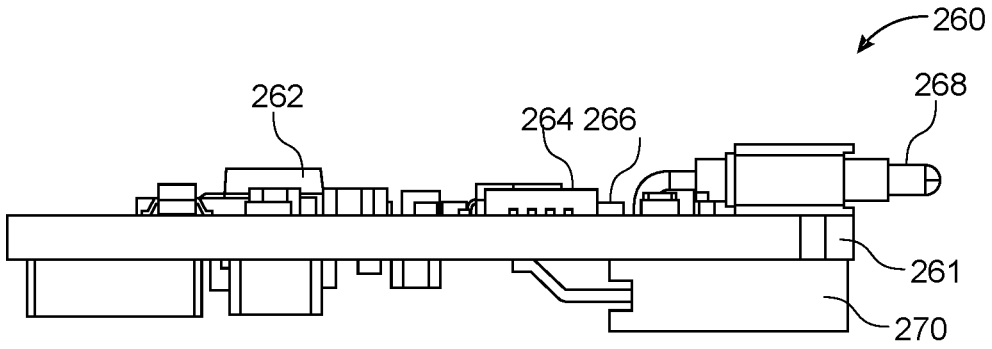
Figure 6:
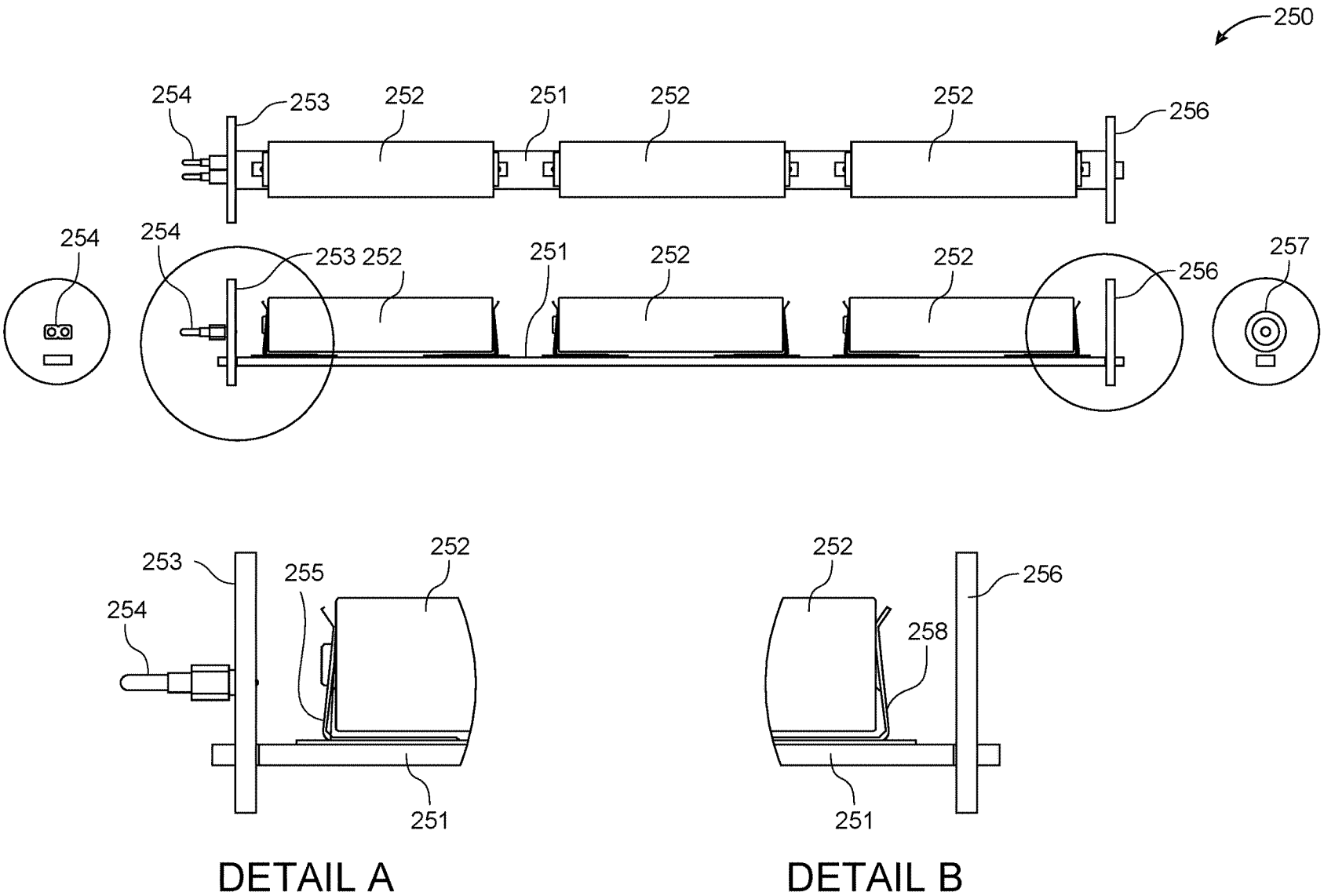
FIG. 6 is an exemplary combined top, side, left end, right end and detailed views of the pressure activated power module for any pressure activated variant of the downhole actuation device described herein.

As noted in FIG. 6, on the battery assembly circuit board 256, there are concentric connectors 257 that are spaced such that the connector to the bottom circuit board of the power module 268 located on the solenoid activation PCB 260 in FIGS. 5-A-5-C will contact both the positive and negative terminals no matter the angular orientation of the insertable power module with reference to the activation module. This also holds true for the connector to the bottom circuit board of the power module 568 located on the gas activation PCB 560 in FIGS. 22-24 will contact both the positive and negative terminals no matter the angular orientation of the insertable power module with reference to the activation module. This is due to the centralization of one of the conductors while the other conductor is a fixed distance radially to the center conductor. In this case, the pins are separated by approximately 2.54 mm (0.1"). The centric conductors on the bottom of the power module are spaced to provide power no matter the angle. Further, on the solenoid activation PCB 260, one of the pins is exactly in the center to make contact with the center pad on the bottom of the power module PCB. Whereas, on the non-explosive pyrotechnic-type PCB 560 in FIGS. 15-17, one of the pins is exactly center. Hence, on the bottom of the PCB, the spacing is such to ensure that as the modules are rotated with respect to each other, the outer pin will move around the outer conductor circle.

In some embodiments of the downhole actuator device, the insertable power module 250 comprises at least one battery 252.

In some embodiments of the downhole actuator device, the insertable power module 250 comprises a plurality of batteries 252.

In some embodiments of the downhole actuator device 200, the at least one battery 252 configuration of the insertable power module 250 comprises a 1.5V battery, a 3V battery, a 3.7V battery, a 3.9V battery, a 4.5V battery, a 9V battery, an E battery, a PP3 battery, a 6LR61 battery, a 6F22 battery, a 1604A battery, a 1604D battery, a MN1604 battery, an A battery, a AA battery, a AAA battery, a B battery, a C battery, a D battery, a DD battery, an F battery, (commonly found in 6V rectangular lantern batteries), an aluminum-air battery, a lithium-ion battery, a lithium polymer battery, an alkaline battery, a lead-acid battery, a nickel battery, a nickel-cadmium battery, a nickel-metal hydride battery, or a solid-state composition battery.

In some embodiments of the downhole actuator device 200, the configuration of the insertable power module 250 with a plurality of batteries comprises a plurality of 1.5V batteries, a plurality of 3V batteries, a plurality of 3.7V batteries, a plurality of 3.9V batteries, a plurality of 4.5V batteries, a plurality of 9V batteries, a plurality of E batteries, a plurality of PP3 batteries, a plurality of 6LR61 batteries, a plurality of 6F22 batteries, a plurality of 1604A batteries, a plurality of 1604D batteries, a plurality of MN1604 batteries, a plurality of A batteries, a plurality of AA batteries, a plurality of AAA batteries, a plurality of B batteries, a plurality of C batteries, a plurality of D batteries, a plurality of DD batteries, a plurality of F batteries, (commonly found in 6V rectangular lantern batteries), a plurality of aluminum-air batteries, a plurality of lithium-ion batteries, a plurality of lithium polymer batteries, a plurality of alkaline batteries, a plurality of lead-acid batteries, a plurality of nickel batteries, a plurality of nickel-cadmium batteries, a plurality of nickel-metal hydride batteries, or a plurality of solid-state composition batteries.

In some embodiments of the downhole actuator device, the insertable power module 250 comprises a plurality of batteries arranged in series circuitry.

In some embodiments of the downhole actuator device, the insertable power module 250 comprises a plurality of batteries arranged in parallel circuitry.

In some embodiments of the downhole actuator device, the insertable power module 250 comprises a plurality of batteries arranged in series-parallel circuitry.

In any one of the embodiments, the downhole actuator device, is configurable to adapt to any one of or a plurality of conveyance mechanisms for downhole delivery and/or retrieval comprising: a slickline cable, a wireline cable, a coiled tubing, a drill pipe, a well tractor, a casing, and/or a tubing.

Referring once again to FIGS. 2 through 6 the function of one preferred variation of the pressure activated downhole activation trigger is described as follows;

The fully assembled pressure-activated downhole trigger 200 comprises a series of core components including: a pressure chamber 201, an insertable activation module 203 comprising a solenoid 202 with a plunger 204, retaining balls 206 and a solenoid-type timer activation PCB 260; a mechanical trigger 208 capable of releasing a force or pressure within the pressure chamber when activated by the insertable activation module 203; the mechanical trigger comprising a trigger spring 210, a trigger sleeve 212 and sear arms 214; and a pressure responsive pilot valve 216 comprising a spring to keep the valve in a normally closed position blocking an external port 224 exposed to high pressure downhole fluids.

Further, the preferred variation of the fully assembled pressure-activated downhole trigger 200 comprises an insertable power module 250 comprising at least one battery 252 or a plurality of batteries 252 and an insertable pressure actuation member comprises a pressure activated piston 240.

The fully assembled pressure-activated downhole trigger 200 can then be fitted with a variety of variable subs or cable heads 230, 231, 232 configurable to accommodate delivery and retrieval of the device in a borehole.

Further still, the preferred variation of the fully assembled pressure-activated downhole trigger can be configurable to adapt to any one of, or a plurality of conveyance mechanisms such as a slickline (typical, but not shown), a wireline 117 (not typical, but possible), a coiled tubing, a segment of drill pipe, a segment of tubing, a segment of casing and or a well tractor and delivered to a desired depth in the borehole.

Once delivered to a desired depth, shear pins placed in in a shear sleeve 242, shear off, allowing the pressure activated piston 240 to move and connect to the battery contacts in the power module 250 to close the electrical circuit.

The power module 250, containing at least one, and preferable a plurality of batteries 252 provides power to the solenoid-type timer activation PCB 260 which in turn initiates a timed circuit that counts down before providing power to the solenoid 202 and activates the plunger 204, at which point the plunger retracts and releases the retaining balls or dogs 206.

The retaining balls or dogs 206, drop out of the way and release the trigger sleeve 212, wherein the trigger spring 210 causes the sleeve to move and release the sear arms 214 which fall away within the sear arm housing 215.

Once the sear arms 214 are released, the pressure responsive pilot valve 216 is forced to move from a closed position to an open position due to the force exerted by the pilot valve spring 218, wherein, when said pressure responsive member moves from a closed position to an open position, wellbore fluid is allowed to enter the device thru the exposed passage 224 in the pressure chamber distal to said pressure responsive member, traveling down the internal exhaust port 226 of the bottom sub 232 to an awaiting tool such as for example a hydrostatic setting tool, (not shown).

Referring now to FIGS. 5A-5C, one preferred exemplary embodiment of a solenoid activation printed circuit board PCB 260 is shown.

In a top view FIG. 5-A of the exemplary board 260 is shown one configuration the circuit board 261 comprising a MOSFET 262, AKA a metal-oxide-semiconductor field-effect transistor, a microcontroller 264, a crystal oscillator 266 and connector 268 for connecting to the bottom circuit board of the battery/power module.

In a bottom view FIG. 5-B of the exemplary board 261 is shown a further corresponding configuration the circuit board comprising a connector for interface to the microcontroller unit 270, aka MCU, and a step-up voltage converter 272.

In the side view of FIG. 5-C all components of the exemplary board 261 are shown.

Referring now to FIG. 6, a combined top, side, left end, right end and detailed view of an exemplary pressure activated power module 250 for any pressure activated variant of the downhole actuation device is shown. As note previously, the power module 250 is configurable with as few as one battery 252 or as many as a plurality of batteries 252. Further, the plurality of batteries can be configured in a series circuitry, in a parallel circuitry or a series-parallel circuitry configuration.

The exemplary power module 250 shown herein comprises a battery assembly main circuit board 251, a plurality of batteries 252, a battery assembly top circuit board 253, pressure activated short circuit pins 254, a positive terminal 255, a battery assembly bottom circuit board 256, concentric conductors 257 and a negative terminal 258, as shown.

In some embodiments, the downhole actuator device is configurable to adapt to a wireline or e-line; an e-coil tubing; or a digital slickline for surface activation of the insertable activation module.

Figure 7A:
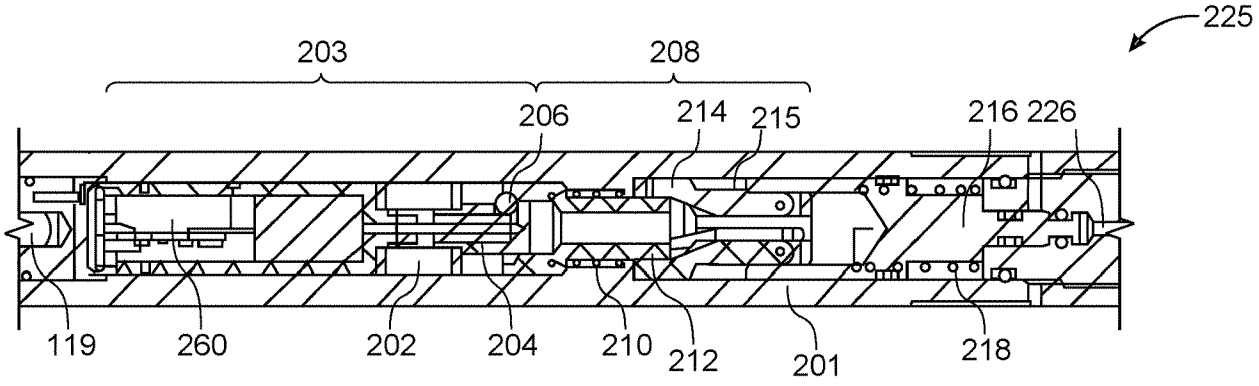
FIG. 7-A is an exemplary detailed cross-section view of the core components of a solenoid-type surface activated trigger FIG. 7-B is an exemplary cross-section view of an entire solenoid-type surface activated trigger of the downhole actuation device in its initial state before activation by an operator on the surface.
Figure 7B:
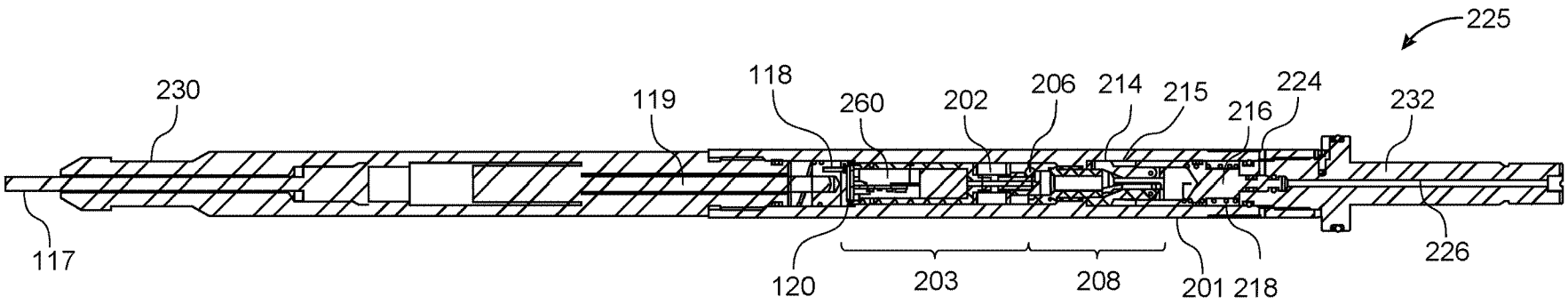
Figure 8:
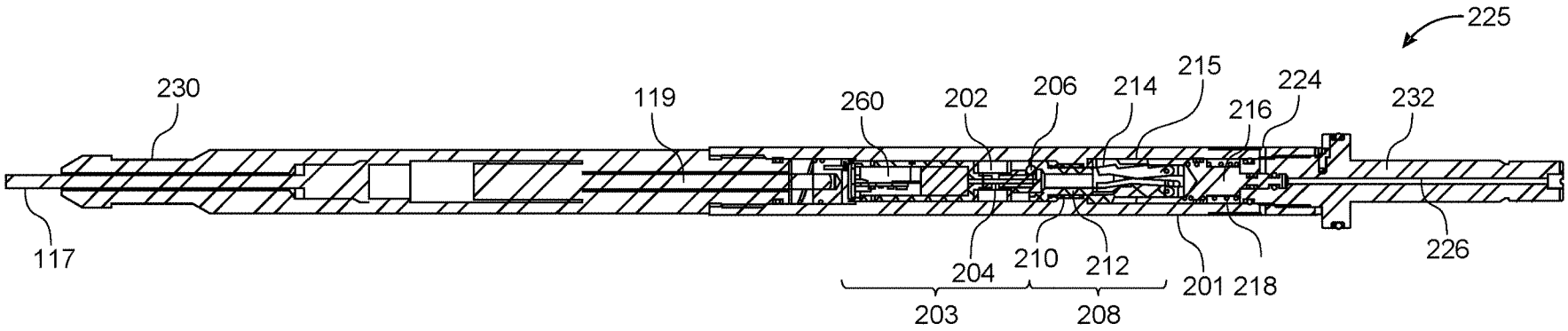
FIG. 8 is an exemplary cross-section view of the entire solenoid-type surface activated trigger of FIG. 7-B in its final state following the shift of the pressure responsive pilot valve from its initially closed position to its final open position.

Referring now to FIGS. 7-A through 8, the function of surface activation variation downhole activation trigger 225 is described as follows:

The fully assembled surface-activated downhole trigger 225 comprises a series of core components including: a pressure chamber 201, an insertable activation module 203 comprising a solenoid 202 with a plunger 204, retaining balls 206 and a solenoid-type activation PCB 260; a mechanical trigger 208 capable of generating a force or pressure within the pressure chamber when activated by the insertable activation module 203; the mechanical trigger comprising a trigger spring 210, a trigger sleeve 212 and sear arms 214; and a pressure responsive pilot valve 216 comprising a spring to keep the valve in a normally closed position blocking an external port 224 exposed to high pressure downhole fluids. Alternately Further, the preferred variation of the fully assembled surface-activated downhole trigger 225 comprises a cable head 230, cable head connector 119, a conductor 120, an insulator 118 and wireline 117, or an equivalent e-line capable of delivering data and current to the trigger. (These components obviate the need for a power module and pressure activated piston described for the pressure activated variation of the device).

The fully assembled surface-activated downhole trigger 225 can then be further fitted with a variety of variable subs 231, 232 configurable to accommodate delivery and retrieval of the device and attachments in a borehole.

Further still, the preferred variation of the fully assembled surface-activated downhole trigger 225 can be configurable to adapt to any one, or a plurality of conveyance mechanisms in addition to the wireline 117, such as, a coiled tubing, a segment of drill pipe, a segment of tubing, a segment of casing and or a well tractor and delivered to a desired depth in the borehole.

Once delivered to a desired depth, an operator on the surface can direct a signal and/or electrical current to provide power to the solenoid-type timer activation PCB 260 which in turn initiates a timed circuit that counts down before providing power to the solenoid 202 and activates the plunger 204, at which point the plunger retracts and releases the retaining balls or dogs 206.

The retaining balls or dogs 206, drop out of the way and release the trigger sleeve 212, wherein the trigger spring 210 causes the sleeve to move and release the sear arms 214 which fall away within the sear arm housing 215.

Once the sear arms 214 are released, the pressure responsive pilot valve 216 is forced to move from a closed position to an open position due to the force exerted by the pilot valve spring 218, wherein, when said pressure responsive member moves from a closed position to an open position, wellbore fluid is allowed to enter the device thru the exposed passage 224 in the pressure chamber distal to said pressure responsive member, traveling down the internal exhaust port 226 of the bottom sub 232 to an awaiting tool such as for example, a hydrostatic setting tool, (not shown).

In yet another variation of the downhole actuator device, the trigger is configurable for yet another means of generating a force or pressure within the pressure chamber when activated utilizing a non-explosive pyrotechnic device such as a rocket engine. For example, such a rocket engine would have no more than 62.5 grams of total propellant as defined by the US Department of Justice and ATF guidelines and designed as a single-use motor or as reload kits capable of reloading no more than 62.5 grams of propellant into a reusable motor casing.

Figure 9:
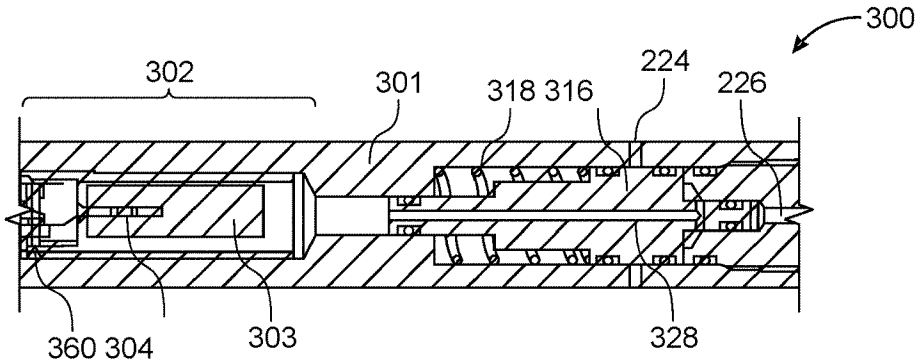
FIG. 9 is an exemplary cross-section view of a non-explosive pyrotechnic-type trigger's core components of the downhole actuation device.
Figure 10:
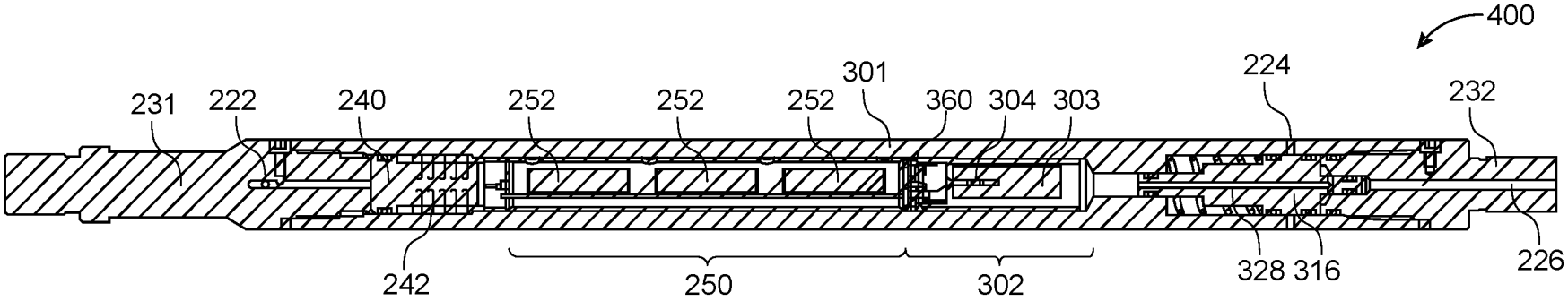
FIG. 10 is an exemplary cross-section view of an entire non-explosive pyrotechnic-type pressure activated trigger of the downhole actuation device in its initial state before pressure activation.
Figure 11:
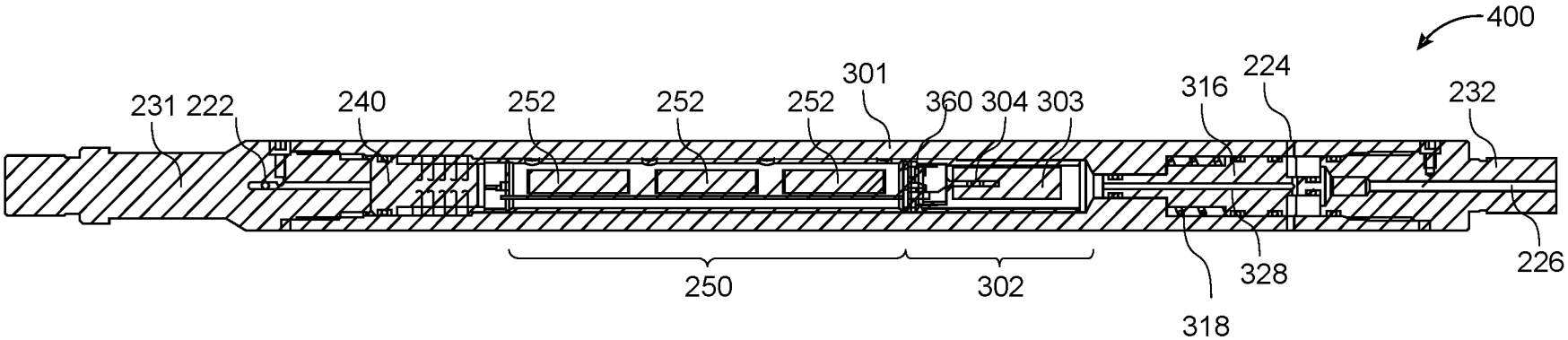
FIG. 11 is an exemplary cross-section view of the entire non-explosive pyrotechnic-type pressure activated trigger of FIG. 11 in its final state following the shift of the pressure responsive pilot valve from its initially closed position to its final open position.

Referring now to FIGS. 9-11, the function of another preferred variation of the pressure activated downhole activation trigger comprising a pressure activated non-explosive pyrotechnic device is described as follows;

This variation of a fully assembled pressure-activated downhole trigger 400 comprises a series of core components 300 including: a pressure chamber 301, an insertable activation module 302 comprising a rocket engine 303 with an ignitor 304 capable of generating a force or pressure within the pressure chamber when activated by the insertable power module 250, and a rocket engine or R-type activation PCB 360; and a pressure responsive pilot valve 316 comprising a spring to keep the valve in a normally closed position blocking an external port 224 exposed to high pressure downhole fluids and an internal port 328 in the pressure responsive pilot valve.

Further, the preferred variation of the fully assembled pressure-activated downhole trigger 400 comprises an insertable power module 250 comprising at least one battery 252 or a plurality of batteries 252 and an insertable pressure actuation member comprises a pressure activated piston 240.

The fully assembled pressure-activated downhole trigger 400 can then be fitted with a variety of variable subs or cable heads 230, 231, 232 configurable to accommodate delivery and retrieval of the device in a borehole.

Further still, the preferred variation of the fully assembled pressure-activated downhole trigger 400 can be configurable to adapt to any one of, or a plurality of conveyance mechanisms such as a slickline (typical, but not shown), a wireline 117 (not typical, but possible), a coiled tubing, a segment of drill pipe, a segment of tubing, a segment of casing and or a well tractor and delivered to a desired depth in the borehole.

Once delivered to a desired depth, and the wellbore pressure detected through the proximal external port 222 reaches the preset pressure, the shear pins placed in in a shear sleeve 242, shear off, allowing the pressure activated piston 240 to move and connect to the battery contacts in the power module 250 to close the electrical circuit.

The power module 250, containing at least one, and preferable a plurality of batteries 252 provides power to a conductor adjacent to the R-type timer activation PCB 360 which in turn initiates a timed circuit that counts down before providing power to the ignitor 304 and activates the non-explosive pyrotechnic 303 (i.e.: rocket engine), at which point the rocket engine ignites and releases high pressure gasses into the pressure chamber 301.

The pressure from gasses produced by the rocket engine pass through the internal passage 328 of the pressure responsive pilot valve 316 which in turn is forced to move from a closed position to an open position due to the force exerted by the pilot valve by the building pressure of the gasses and the spring 318, wherein, when said pressure responsive member moves from a closed position to an open position, wellbore fluid is allowed to enter the device thru the exposed passage 224 in the pressure chamber distal to said pressure responsive member, traveling down the internal exhaust port 226 of the bottom sub 232 to an awaiting tool such as for example, a hydrostatic setting tool, (not shown).

In some embodiments, the non-explosive pyrotechnic downhole actuator device is configurable to adapt to a wireline or e-line; an e-coil tubing; or a digital slickline for surface activation of the insertable activation module.

Figure 12:
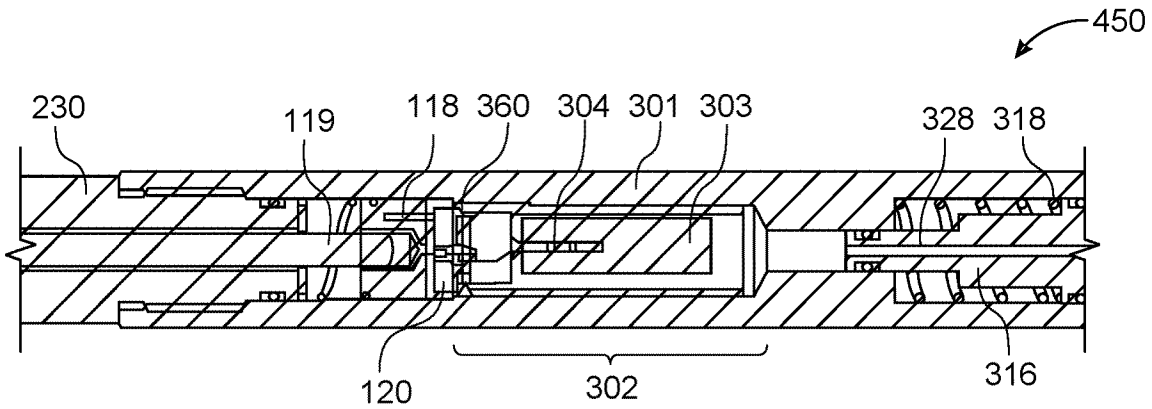
FIG. 12 is an exemplary cross-section view of cross-section view of a non-explosive pyrotechnic-type trigger's core components of the downhole actuation device with a representative surface activated wireline connection to a conductor on the rear side of the activation PCB, in its initial state before activation by an operator on the surface.
Figure 13:
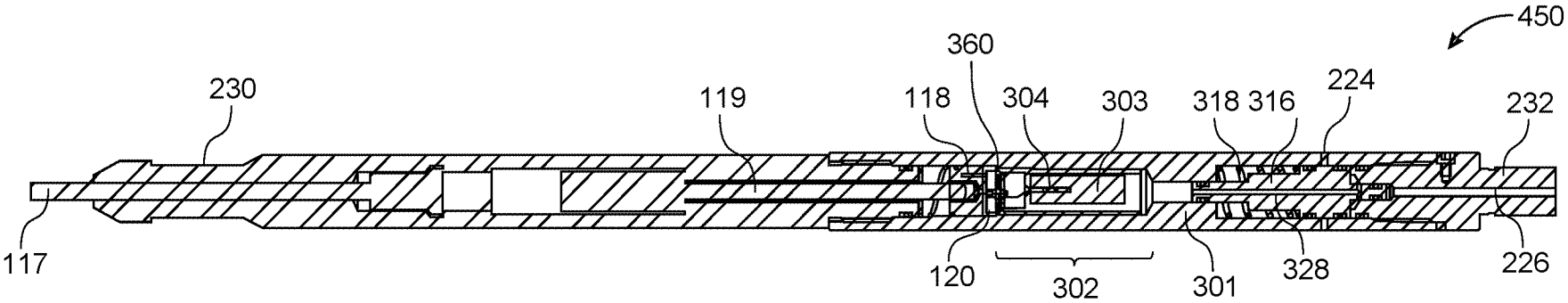
FIG. 13 is an exemplary cross-section view of an entire non-explosive pyrotechnic-type surface activated trigger of the downhole actuation device in its initial state before activation by an operator on the surface.
Figure 14:
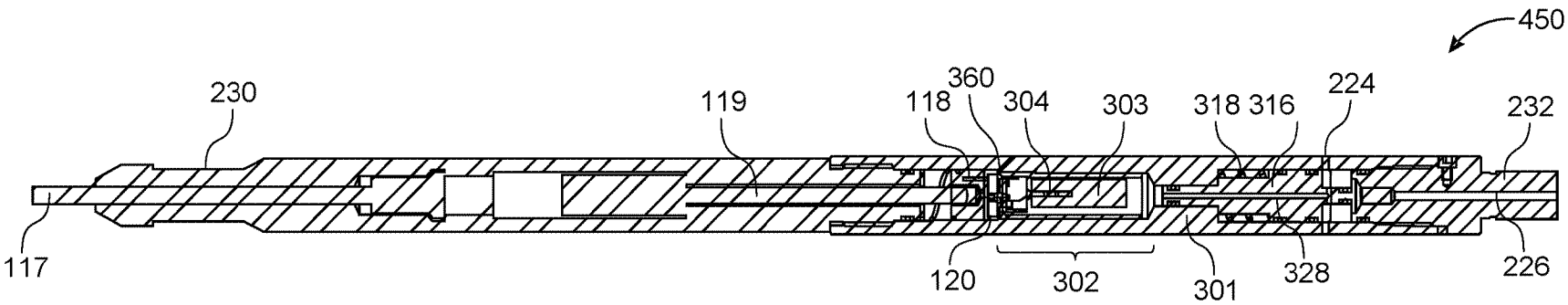
FIG. 14 is an exemplary cross-section view of the entire non-explosive pyrotechnic-type surface activated trigger of FIG. 13 in its final state following the shift of the pressure responsive pilot valve from its initially closed position to its final open position.

Referring now to FIGS. 12 through 14, the function of surface activation variation of the non-explosive pyrotechnic downhole activation trigger is described as follows:

This variation of a fully assembled pressure-activated downhole trigger 450 comprises a series of core components 300 including: a pressure chamber 301, an insertable activation module 302 comprising a rocket engine 303 with an ignitor 304 capable of generating a force or pressure within the pressure chamber when activated from the surface and a rocket engine or R-type activation PCB 360; and a pressure responsive pilot valve 316 comprising a spring 318 to keep the valve in a normally closed position blocking an external port 224 exposed to high pressure downhole fluids and an internal port 328 in the pressure responsive pilot valve.

Further, the preferred variation of the fully assembled surface-activated non-explosive pyrotechnic (rocket engine) downhole trigger 450 comprises a cable head 230, a cable line conductor 119, a conductor 120, an insulator 118 and wireline 117, or an equivalent e-line capable of delivering data and current to the trigger. (These components obviate the need for a power module and pressure activated piston described for the pressure activated variation of the device).

The fully assembled surface-activated downhole trigger 450 can then be fitted with a variety of variable subs 231, 232 configurable to accommodate delivery and retrieval of the device and attachments in a borehole.

Further still, the preferred variation of the fully assembled surface-activated non-explosive pyrotechnic (rocket engine) downhole trigger 450 can be configurable to adapt to any one of, or a plurality of conveyance mechanisms in addition to the wireline 117, such as, a coiled tubing, a segment of drill pipe, a segment of tubing, a segment of casing and or a well tractor and delivered to a desired depth in the borehole.

Once delivered to a desired depth, an operator on the surface can direct a signal and/or electrical current to provide power to the rocket engine or R-type activation PCB 360 which in turn initiates the ignitor 304 and activates the non-explosive pyrotechnic 303 (i.e.: rocket engine), at which point the rocket engine ignites and releases high pressure gasses into the pressure chamber 301.

The pressure from gasses produced by the rocket engine pass through the internal passage 328 of the pressure responsive pilot valve 316 which in turn is forced to move from a closed position to an open position due to the force exerted by the pilot valve by the building pressure of the gasses and the spring 318, wherein, when said pressure responsive member moves from a closed position to an open position, wellbore fluid is allowed to enter the device thru the exposed passage 224 in the pressure chamber distal to said pressure responsive member, traveling down the internal exhaust port 226 of the bottom sub 232 to an awaiting tool such as for example, a hydrostatic setting tool, (not shown).

Figure 15:
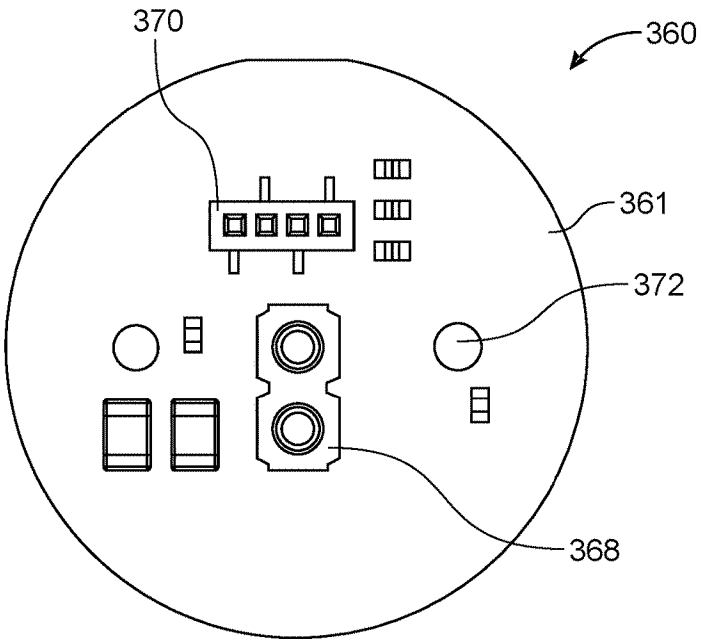
FIG. 15 is an exemplary top view of the non-explosive pyrotechnic-type trigger activation printed circuit board of the downhole actuation device.
Figure 16:
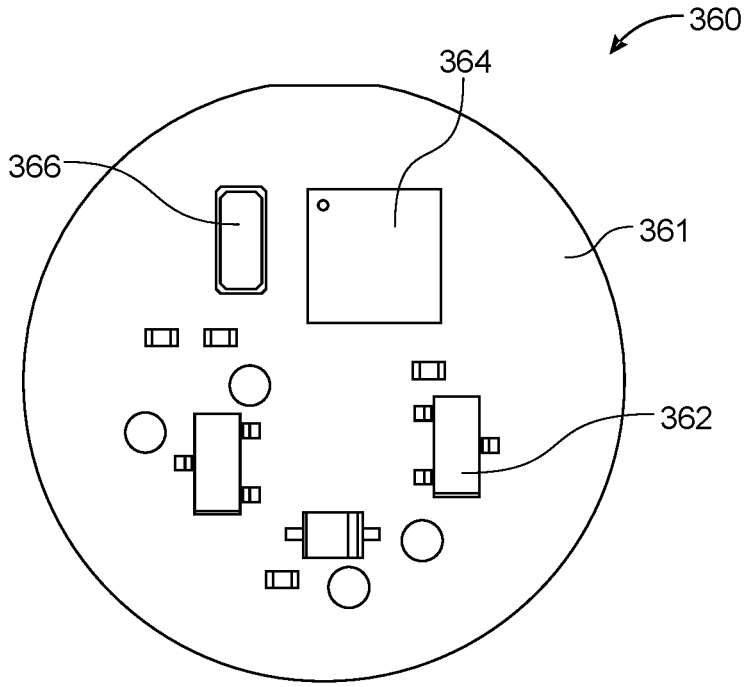
FIG. 16 is an exemplary bottom view of the non-explosive pyrotechnic-type trigger activation printed circuit board of the downhole actuation device.
Figure 17:
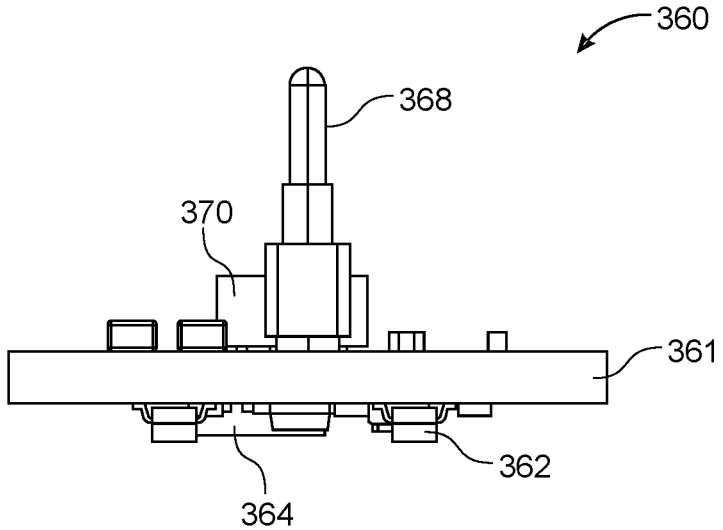
FIG. 17 is an exemplary side view of the non-explosive pyrotechnic-type trigger activation printed circuit board of the downhole actuation device.

Referring now to FIGS. 15-17, one preferred exemplary embodiment of a rocket engine or R-type activation printed circuit board PCB 360 is shown.

In a top view FIG. 15 of the exemplary board 360 is shown one configuration the circuit board 361 comprising a connector 368 affixed to the printed circuit board for connecting to the battery/power module, a connector for interface to the micro-controller unit 370, aka MCU, and a rocket engine ignitor connection 372.

In a bottom view FIG. 16 of the exemplary board 360 is shown a further corresponding configuration the circuit board 361 comprising a MOSFET 362, AKA a metal-oxide-semiconductor field-effect transistor, a microcontroller 364, and a crystal oscillator 366.

In the side view of FIG. 17 all components of the exemplary board 360 are shown.

As noted previously in FIG. 6, on the battery assembly circuit board 256, there are concentric connectors 257 that are spaced such that the connector to the bottom circuit board of the power module 368 located on the R-type activation printed circuit board PCB 360 in FIGS. 15-17 will contact both the positive and negative terminals no matter the angular orientation of the insertable power module with reference to the activation module. On the non-explosive pyrotechnic-type PCB 360 in FIGS. 15-17, one of the pins is exactly center. Hence, on the bottom of the PCB, the spacing is such to ensure that as the modules are rotated with respect to each other, the outer pin will move around the outer conductor circle.

In yet another variation of the downhole actuator device, the trigger is configurable for yet another means of generating a force or pressure within the pressure chamber when activated utilizing a non-explosive gas device such as a compressed gas cylinder with CO2 or other inert gas.

Figure 18:
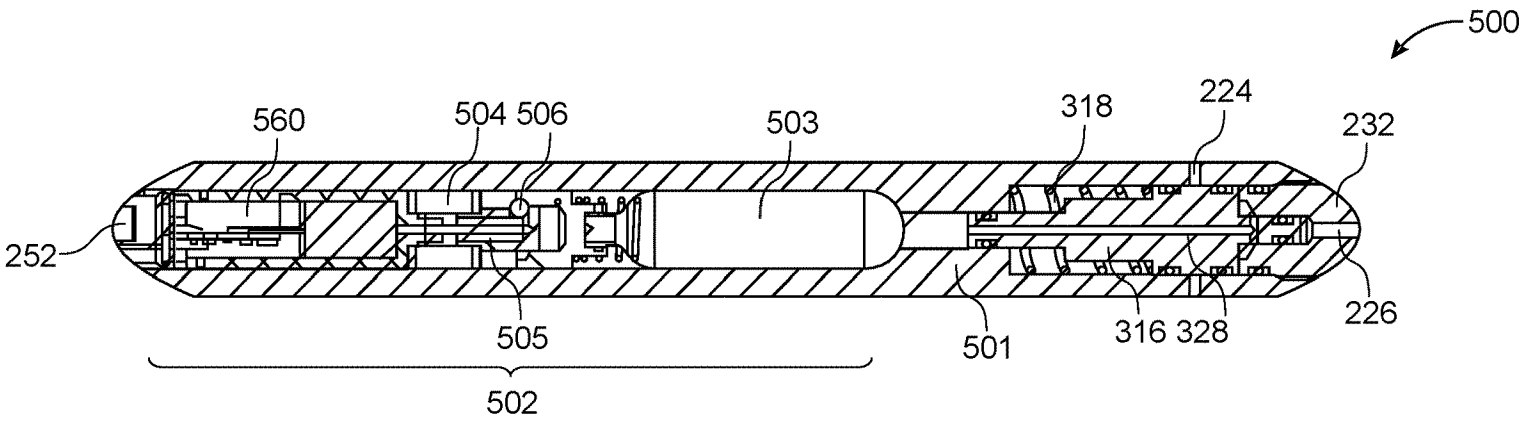
FIG. 18 is an exemplary cross-section view of a non-explosive gas-type trigger's pressure activation core components of the downhole actuation device.
Figure 19A:
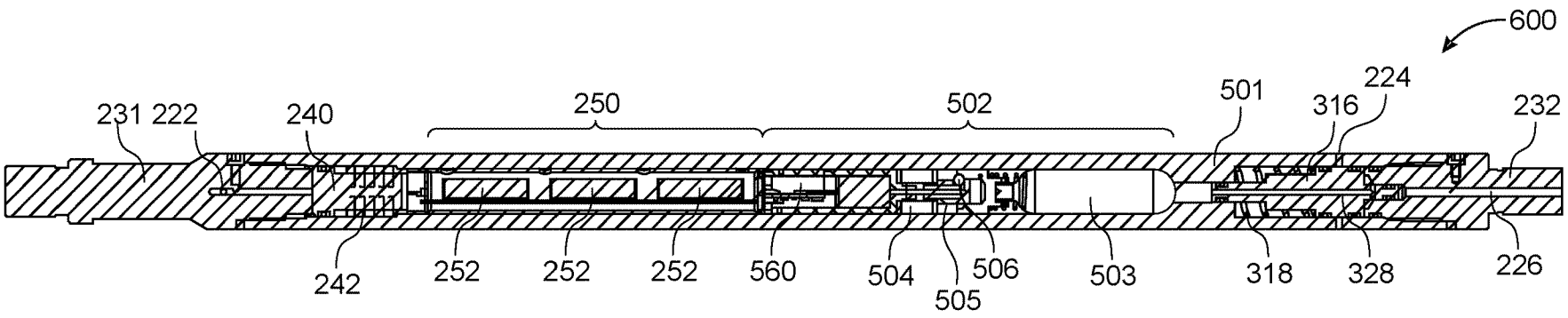
FIG. 19-A is an exemplary cross-section view of an entire non-explosive gas-type pressure activated trigger of the downhole actuation device in its initial state before pressure activation.
Figure 19B:
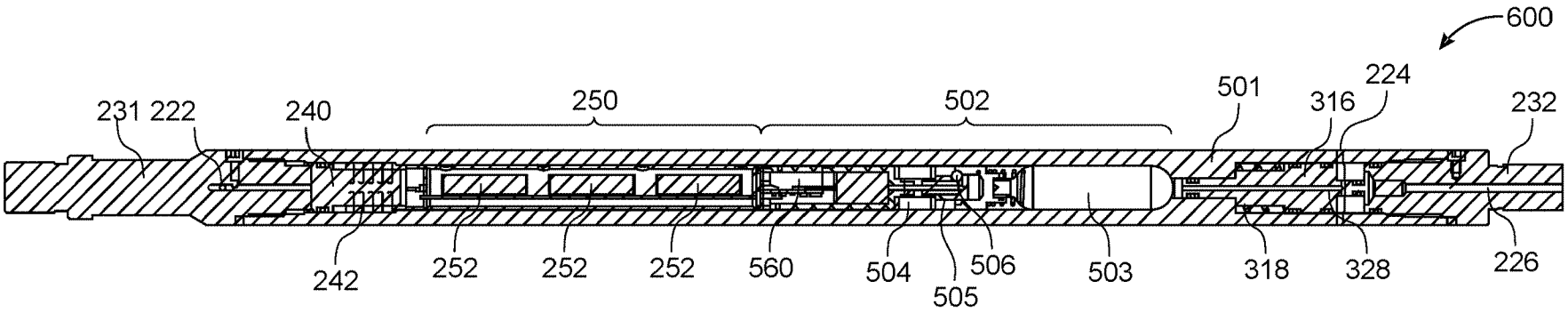

Referring now to FIGS. 18-19-B, the function of another preferred variation of the gas pressure activated downhole activation trigger comprising a pressure activated non-explosive gas device is described as follows;

This variation of a fully assembled pressure-activated gas-type downhole trigger 600 comprises a series of core components 500 including: a pressure chamber 501, an insertable activation module 502 comprising a gas cannister 503 with a solenoid 504 and plunger 505 and solenoid balls or dogs 506 capable of generating a force or pressure within the pressure chamber when activated by the insertable power module 250, and a gas or G-type timer activation PCB 560; and a pressure responsive pilot valve 316 comprising a spring to keep the valve in a normally closed position blocking an external port 224 exposed to high pressure downhole fluids and an internal port 328 in the pressure responsive pilot valve.

Further, the exemplary variation of the fully assembled pressure-activated gas-type downhole trigger 600 comprises an insertable power module 250 comprising at least one battery 252 or a plurality of batteries 252 and an insertable pressure actuation member comprises a pressure activated piston 240 and shear sleeve 242 with shear pins.

The fully assembled pressure-activated downhole gas-type trigger 600 can then be fitted with a variety of variable subs or cable heads 230, 231, 232 configurable to accommodate delivery and retrieval of the device in a borehole.

Further still, the preferred variation of the fully assembled gas-type pressure-activated downhole trigger 600 can be configurable to adapt to any one of, or a plurality of conveyance mechanisms such as a slickline (typical, but not shown), a wireline 117 (not typical, but possible), a coiled tubing, a segment of drill pipe, a segment of tubing, a segment of casing and or a well tractor and delivered to a desired depth in the borehole.

Once delivered to a desired depth, shear pins placed in in a shear sleeve 242, shear off, allowing the pressure activated piston 240 to move and connect to the battery contacts in the power module 250 to close the electrical circuit.

The power module 250, containing at least one, and preferable a plurality of batteries 252 provides power to the conductor adjacent to the G-type timer activation PCB 560 which in turn initiates a timed circuit that counts down before providing power to the solenoid 504 and plunger 505 and activates the non-explosive gas chamber 503 (i.e.: cannister), at which point the cannister discharges and releases high pressure gasses into the pressure chamber 501.

The pressure from gasses produced by the gas chamber 503 pass through the internal passage 328 of the pressure responsive pilot valve 316 which in turn is forced to move from a closed position to an open position, overcoming the force exerted by the pilot valve spring used to keep it closed, by the building pressure of the gasses distal to the pilot valve and the spring 318, wherein, when said pressure responsive member 316 moves from a closed position to an open position, wellbore fluid is allowed to enter the device thru the exposed passage 224 in the pressure chamber distal to said pressure responsive member, traveling down the internal exhaust port 226 of the bottom sub 232 to an awaiting tool such as for example, a hydrostatic setting tool, (not shown). Once opened, the hydrostatic pressure from the well will keep the pilot valve open opened.

In some embodiments, the downhole gas-type actuator device 650 is configurable to adapt to a wireline or e-line; an e-coil tubing; or a digital slickline for surface activation of the insertable activation module.

Figure 20:
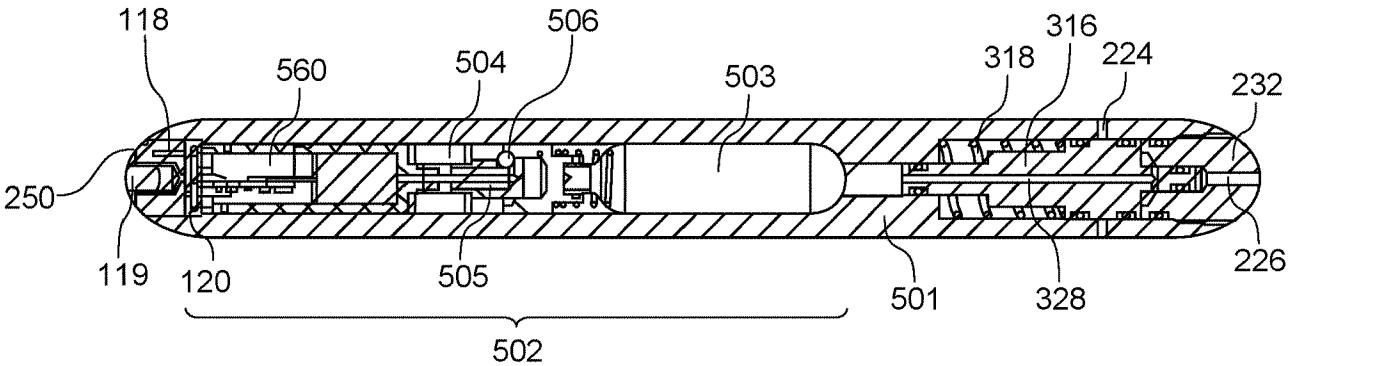
FIG. 20 is an exemplary cross-section view of a non-explosive gas-type trigger's surface activation core components of the downhole actuation device.
Figure 21A:
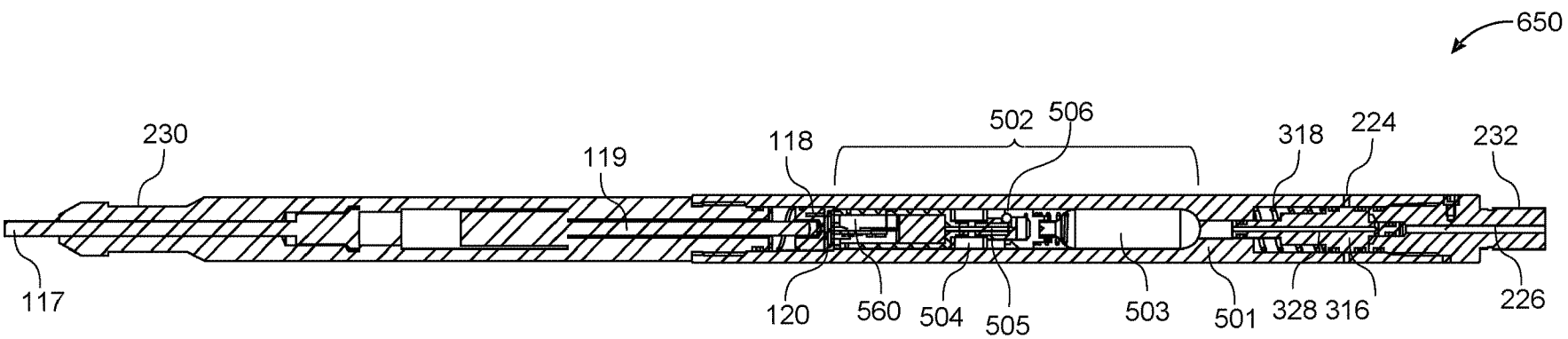
FIG. 21-A is an exemplary cross-section view of an entire non-explosive gas-type surface activated trigger of the downhole actuation device in its initial state before activation by an operator on the surface.
Figure 21B:
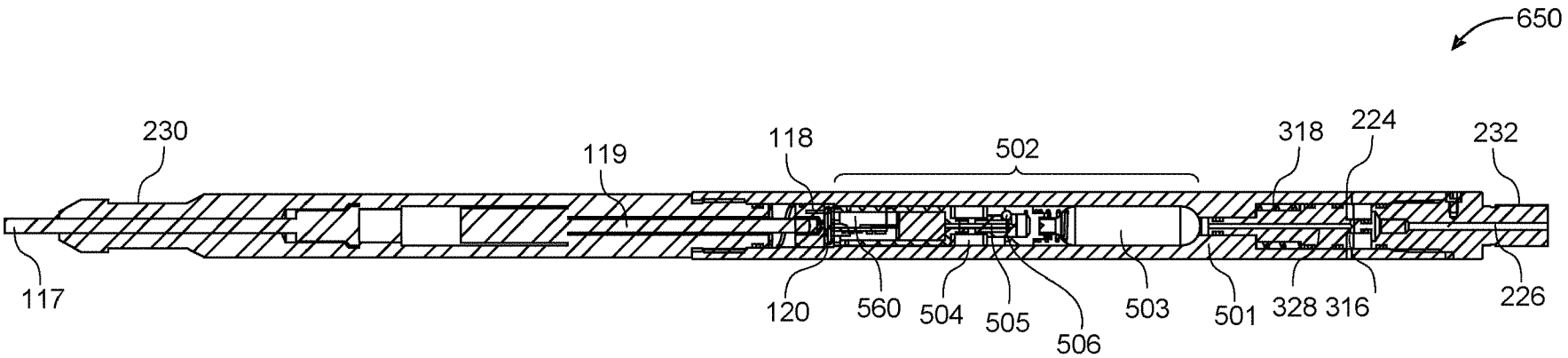

Referring now to FIGS. 20 through 21-B, the function of surface activation variation of the non-explosive gas-type downhole activation trigger 650 is described as follows:

This variation of a fully assembled pressure-activated gas-type downhole trigger 650 comprises a series of core components 500 including: a pressure chamber 501, an insertable activation module 502 comprising a gas cannister 503 with a solenoid 504 and plunger 505 capable of generating a force or pressure within the pressure chamber when activated by the insertable power module 250, and a gas or G-type timer activation PCB 560; and a pressure responsive pilot valve 316 comprising a spring to keep the valve in a normally closed position blocking an external port 224 exposed to high pressure downhole fluids and an internal port 328 in the pressure responsive pilot valve.

Further, the preferred variation of the fully assembled surface-activated non-explosive gas-type downhole trigger 650 comprises a cable head 230, a cable line conductor 119, a conductor 120, an insulator 118 and wireline 117, or an equivalent e-line capable of delivering data and current to the trigger. (These components obviate the need for a power module and pressure activated piston described for the pressure activated variation of the device).

The fully assembled surface-activated downhole trigger 650 can then be fitted with a variety of variable subs 231, 232 configurable to accommodate delivery and retrieval of the device and attachments in a borehole.

Further still, the exemplary variation of the fully assembled gas-type surface-activated downhole trigger 650 can be configurable to adapt to any one, or a plurality of conveyance mechanisms in addition to the wireline 117, such as, a coiled tubing, a segment of drill pipe, a segment of tubing, a segment of casing and or a well tractor and delivered to a desired depth in the borehole.

Once delivered to a desired depth, an operator on the surface can direct a signal and/or electrical current to provide power to the gas-type activation PCB 560 which in turn initiates or provides power to the solenoid 504 and plunger 505 which activates the non-explosive gas chamber 503 (i.e.: chamber), at which point the cannister discharges and releases high pressure gasses into the pressure chamber 501.

The pressure from gasses produced by the gas chamber 503 pass through the internal passage 328 of the pressure responsive pilot valve 316 which in turn is forced to move from a closed position to an open position, overcoming the force exerted by the pilot valve spring used to keep it closed, by the building pressure of the gasses distal to the pilot valve and the spring 318, wherein, when said pressure responsive member 316 moves from a closed position to an open position, wellbore fluid is allowed to enter the device thru the exposed passage 224 in the pressure chamber distal to said pressure responsive member, traveling down the internal exhaust port 226 of the bottom sub 232 to an awaiting tool such as for example, a hydrostatic setting tool, (not shown). Once opened, the hydrostatic pressure from the well will keep the pilot valve open opened.

Figure 22:
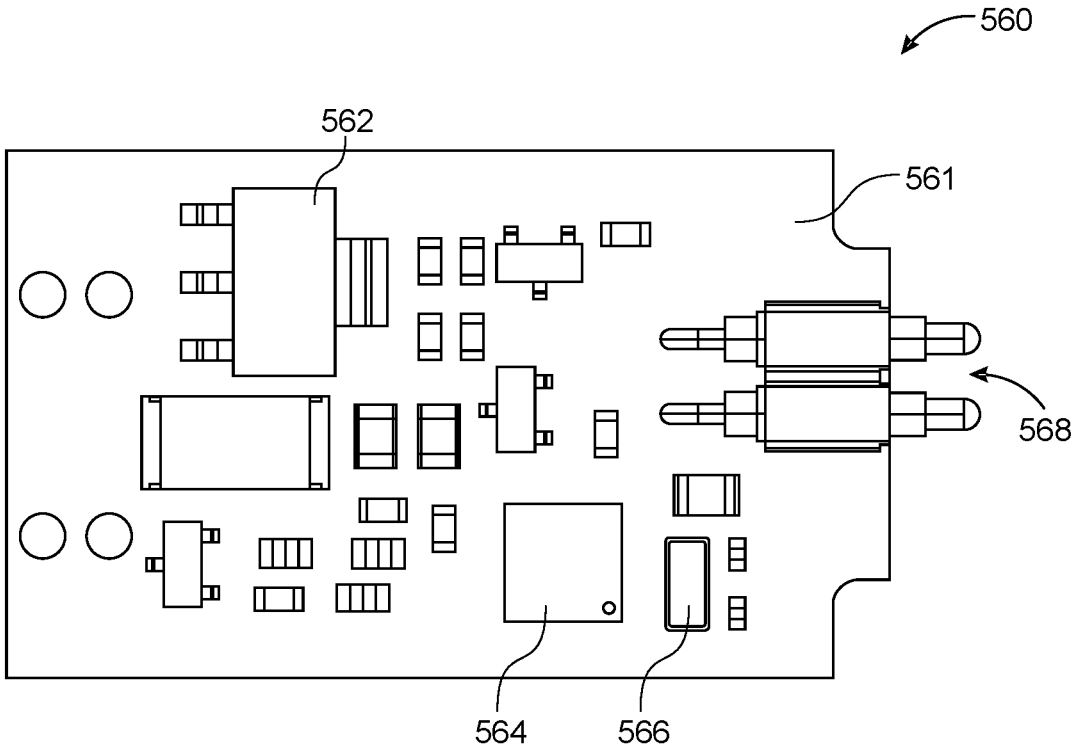
FIG. 22 is an exemplary top view of the non-explosive gas-type trigger activation printed circuit board of the downhole actuation device.
Figure 23:
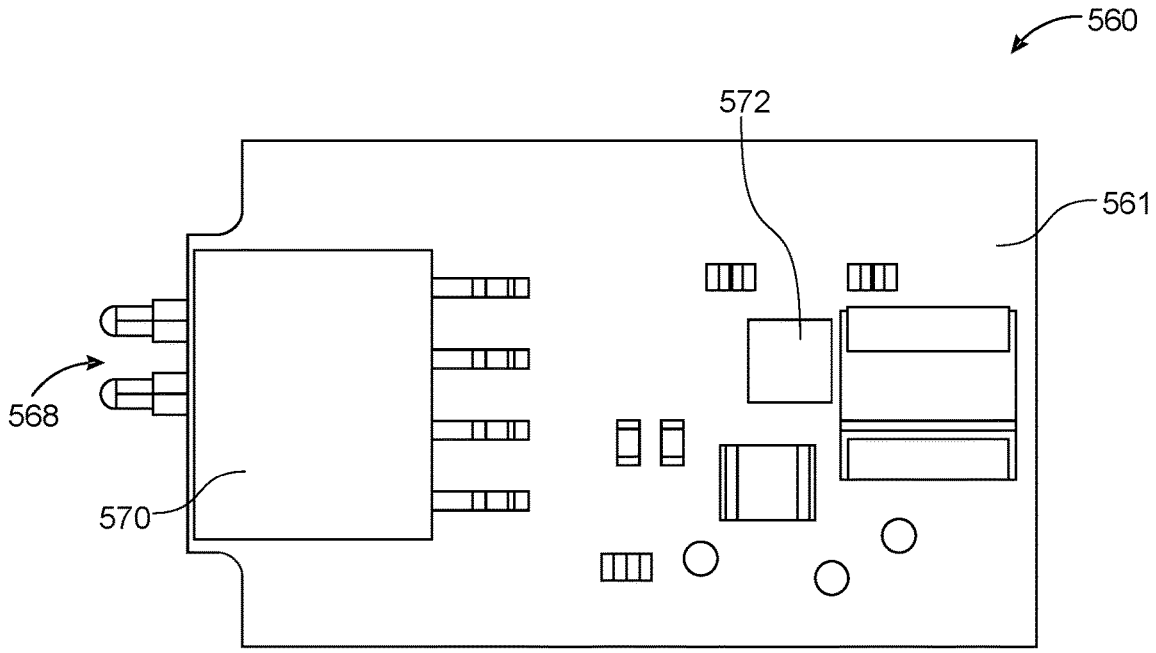
FIG. 23 is an exemplary bottom view of the non-explosive gas-type trigger activation printed circuit board of the downhole actuation device.
Figure 24:
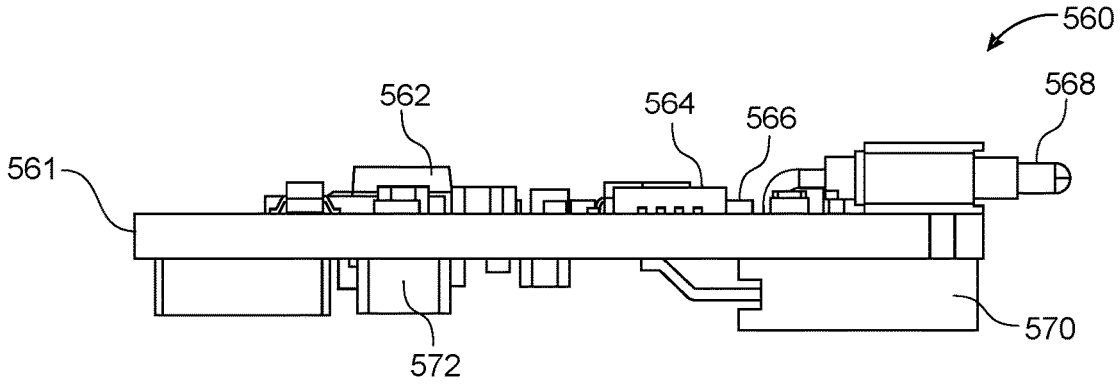
FIG. 24 is an exemplary side view of the non-explosive gas-type trigger activation printed circuit board of the downhole actuation device.

Referring now to FIGS. 22-24, one preferred exemplary embodiment of a solenoid activation printed circuit board PCB 560 is shown.

In a top view FIG. 22 of the exemplary board 560 is shown one configuration the circuit board 561 comprising a MOSFET 562, AKA a metal-oxide-semiconductor field-effect transistor, a microcontroller 564, a crystal oscillator 566 and connector 568 for connecting to the bottom circuit board of the battery/power module.

In a bottom view FIG. 23 of the exemplary board 561 is shown a further corresponding configuration the circuit board comprising a connector for interface to the microcontroller unit 570, aka MCU, and a step-up voltage converter 572.

In the side view of FIG. 24 all components of the exemplary board 561 are shown.

As noted previously in FIG. 6, on the battery assembly circuit board 256, there are concentric connectors 257 that are spaced such that the connector to the bottom circuit board of the power module 268 located on the solenoid activation PCB 260 in FIGS. 5-A-5-C will contact both the positive and negative terminals no matter the angular orientation of the insertable power module with reference to the activation module. This also holds true for the connector to the bottom circuit board of the power module 568 located on the gas activation PCB 560 in FIGS. 22-24 will contact both the positive and negative terminals no matter the angular orientation of the insertable power module with reference to the activation module. This is due to the centralization of one of the conductors while the other conductor is a fixed distance radially to the center conductor. In this case, the pins are separated by approximately 2.54 mm (0.1"). The centric conductors on the bottom of the power module are spaced to provide power no matter the angle. Further, on the solenoid activation PCB 260, one of the pins is exactly in the center to make contact with the center pad on the bottom of the power module PCB.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A downhole actuator device for use in directing wellbore fluid to be used in performing work in a wellbore, said downhole actuator device comprising:

a pressure chamber;

an insertable activation module;

a mechanical trigger capable of generating a force or pressure within the pressure chamber when activated by the insertable activation module; and a pressure responsive member which is selectively moveable from a closed position to an open position by said activation module and mechanical trigger;

wherein said mechanical trigger comprises a plurality of retainer dogs; a trigger sleeve; a trigger sleeve spring; a sear arm housing; and a plurality of sear arms, and wherein when said pressure responsive member moves from the closed position to the open position, wellbore fluid is allowed to enter the device thru an exposed passage in the pressure chamber distal to said pressure responsive member.

2. The insertable activation module of claim 1 comprising:

an electro-mechanical activation mechanism;

a custom logic circuit board;

an integrated timer module on said circuit board; and an activation circuit to carry energy from the circuit board to the electro-mechanical activation mechanism.

3. The downhole actuator device of claim 2, wherein said electro-mechanical activation mechanism comprises a solenoid.

4. The downhole actuator device of claim 2, wherein said timer module comprises:

a time keeping circuit using a microprocessor, microcontroller or other digital processor; or counting circuit without a microprocessor, microcontroller or other processor, such as an oscillator or counter; or a time keeping circuit using an RC oscillator circuit.

5. The downhole actuator device of claim 2, wherein an activation circuit within the insertable activation module comprises:

an electrical conductor mechanism comprising a positive and negative terminal connection on a first end and a positive and negative terminal connection on a second end; and a switch to connect energy in an insertable power module to the electro-mechanical actuation mechanism; or a switch to connect the energy in the insertable power module to a power conversion circuit to step up the voltage to the electro-mechanical actuation mechanism; or a switch to connect the energy in the insertable power module to the power conversion circuit to step down the voltage to the electro-mechanical actuation mechanism; or transistor to connect the energy in the insertable power module to the electro-mechanical actuation mechanism; or a transistor to connect the energy in the insertable power module to the power conversion circuit to step up the voltage to the electro-mechanical actuation mechanism; or a transistor to connect the energy in the insertable power module to the power conversion circuit to step down the voltage to the electro-mechanical actuation mechanism; or relay to connect the energy in the insertable power module to the electro-mechanical actuation mechanism; or a relay to connect the energy in the insertable power module to the power conversion circuit to step up the voltage to the electro-mechanical actuation mechanism; or a relay to connect the energy in the insertable power module to the power conversion circuit to step down the voltage to the electro-mechanical actuation mechanism; or direct conductors between positive terminals on a first end and a second end and negative terminals on the first end and the second end.

6. The mechanical trigger of claim 1 wherein said retainer dogs are configured to drop away and to unconstrain said trigger sleeve when an electro-mechanical activation mechanism activates, said trigger sleeve moves toward said electro-mechanical activation mechanism due to the sleeve spring, thus releasing the sear arms, said sear arms collapse within the sear arm housing and allow the pressure responsive member to move from the closed position to the open position.

7. The pressure responsive member of claim 1 comprising a spring-loaded pilot valve.

8. The downhole actuator device of claim 1, configurable to be adapted with:

an insertable power module; and an insertable pressure actuation member;

within the pressure chamber, for pressure activation of said insertable activation module.

9. The downhole actuator device of claim 8, wherein said insertable power module comprises;

at least one battery; or a plurality of batteries.

10. The at least one battery or plurality of batteries of claim 9, further comprising any number of a plurality of batteries or at least one battery configuration comprising:
5V,
3V;
3.7V,
3.9V,
4.5V;
9V, E battery, PP3, 6LR61, 6F22, 1604A, 1604D, or MN1604;
A;
AA;
AAA;
B;
C;
D;
DD;
F;
Aluminum-air;
lithium ion;
lithium polymer;
alkaline;
lead-acid;
nickel;
nickel-cadmium;
nickel-metal hydride; or
solid-state composition.

11. The plurality of batteries of claim 10, wherein said plurality of batteries are arranged in series circuitry, in parallel circuitry or series-parallel circuitry.

12. The downhole actuator device of claim 8, wherein said insertable pressure actuation member comprises a pressure activated piston.

13. The downhole actuator device of claim 1, configurable to adapt to:
a wireline or e-line;
an e-coil tubing; or
a digital slickline;
for surface activation of said insertable activation module.

14. The downhole actuator device of claim 1, configurable to adapt to:
a cable head; or
a crossover sub; or
a top sub; or
a bottom sub; or
a cable head, a crossover sub, a top sub and a bottom sub; or
any combination thereof.

15. The downhole actuator device of claim 14, configurable to adapt to any one, or a plurality of conveyance mechanisms for downhole delivery and/or retrieval comprising:
a slickline cable;
a wireline cable;
a coiled tubing;
a drill pipe;
a well tractor;
a casing; and
a tubing.

16. A downhole actuator device for use in directing wellbore fluid to be used in performing work in a wellbore, said downhole actuator device comprising:
a pressure chamber;
an insertable activation module comprising:
a solenoid;
a custom logic circuit board;
an integrated timer module on said circuit board; and
an activation circuit to carry energy from the circuit board to the solenoid;
a mechanical trigger capable of releasing a force or pressure within the pressure chamber when activated by the activation circuit; and
a pressure responsive member which is selectively moveable from a closed position to an open position by said activation module and mechanical trigger;
wherein said mechanical trigger comprises a plurality of retainer dogs configured to drop away and to unconstrain a trigger sleeve when activated by said solenoid, said trigger sleeve moves toward said solenoid due to a sleeve spring, releasing a plurality of sear arms, said sear arms collapse within a sear arm housing and allow the pressure responsive member to move from the closed position to the open position; and
wherein, when said pressure responsive member moves from the closed position to the open position, wellbore fluid is allowed to enter the device thru an exposed passage in the pressure chamber distal to said pressure responsive member.

17. The downhole actuator device of claim 16, wherein said device is configurable to be surface activated using externally attached components comprising:
a wireline or e-line;
an e-coil tubing; or
a digital slickline.

18. The downhole actuator device of claim 16, wherein said device is configurable to be pressure activated using internal components within the pressure chamber further comprising:
an insertable power module; and
an insertable pressure actuation member;
wherein said insertable power module comprises:
at least one battery; or
a plurality of batteries arranged in series circuitry, in parallel circuitry or in series-parallel circuitry; and
wherein said insertable pressure actuation member comprises a pressure activated piston.

19. The downhole actuator device of claim 16, configurable for attachment to:
a cable head; or
a crossover sub; or
a top sub; or
a bottom sub; or
a cable head, a crossover sub, a top sub and a bottom sub; or
any combination thereof.

20. The downhole actuator device of claim 19, further configurable to adapt to any one, or a plurality of conveyance mechanisms comprising:
a slickline cable;
a wireline cable;
a coiled tubing;
a drill pipe;
a well tractor;
a casing; and
a tubing.

21. A downhole actuator device for use in directing wellbore fluid to be used in performing work in a wellbore, said downhole actuator device comprising:
a pressure chamber;
insertable activation module comprising:
a solenoid;
a custom logic circuit board;
an integrated timer module on said circuit board; and an activation circuit to carry energy from the circuit board to the solenoid; and a mechanical trigger capable of releasing a force or pressure within the pressure chamber when activated by the activation circuit; and a pressure responsive member which is selectively moveable from a closed position to an open position by said activation module and mechanical trigger;

wherein said mechanical trigger comprises a plurality of retainer dogs configured to drop away and to unconstrain a trigger sleeve when activated by said solenoid, said trigger sleeve moves toward said solenoid due to a sleeve spring, releasing a plurality of sear arms, said sear arms collapse within a sear arm housing and allow the pressure responsive member to move from a closed position to an open position;

wherein, when said pressure responsive member moves from the closed position to the open position, wellbore fluid is allowed to enter the device thru an exposed passage in the pressure chamber distal to said pressure responsive member; and wherein said downhole actuator device is configurable for either surface activation through an electrical circuit sent down from the surface via wireline or comparable mechanism, or for downhole pressure activation with the addition of further pressure chamber internal features comprising an insertable power module and an insertable pressure actuation member.

* * * * *